US009308624B2

(12) United States Patent
Hibino et al.

(10) Patent No.: US 9,308,624 B2
(45) Date of Patent: Apr. 12, 2016

(54) APPARATUS FOR TREATING A PLATE-LIKE MEMBER AND METHOD OF TREATING THE SAME

(75) Inventors: Kazumichi Hibino, Kitanagoya (JP); Yukinori Suzuki, Kitanagoya (JP); Kazuyoshi Maeda, Aichi (JP); Norihito Shibuya, Kitanagoya (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 486 days.

(21) Appl. No.: 13/514,413

(22) PCT Filed: Jun. 6, 2011

(86) PCT No.: PCT/JP2011/003167

§ 371 (c)(1),
(2), (4) Date: Feb. 13, 2013

(87) PCT Pub. No.: WO2011/152073

PCT Pub. Date: Dec. 8, 2011

(65) Prior Publication Data

US 2013/0143473 A1 Jun. 6, 2013

(30) Foreign Application Priority Data

Jun. 4, 2010 (JP) ..... 2010-128542

(51) Int. Cl.

| | |
|---|---|
| ***B24C 3/32*** | (2006.01) |
| ***B24C 1/08*** | (2006.01) ***B24C 3/08*** |
| (2006.01) | ***B24C 3/12*** |
| (2006.01) | ***B24C 9/00*** |
| (2006.01) | ***B24C 1/00*** |
| (2006.01) | |

(52) U.S. Cl.

CPC ... *B24C 3/32* (2013.01); *B24C 1/00* (2013.01); *B24C 1/086* (2013.01); *B24C 3/086* (2013.01); *B24C 3/12* (2013.01); *B24C 3/322* (2013.01); *B24C 9/00* (2013.01); *B24C 9/003* (2013.01)

(58) Field of Classification Search

CPC ..... B24B 1/00; B24B 3/322; B24B 3/32; B24B 9/00; B24B 3/08; B24B 5/04; B24B 3/04; B24B 3/12; B24C 1/00; B24C 3/322; B24C 3/32; B24C 9/00; B24C 3/08; B24C 5/04; B24C 3/04

USPC ..... 451/38, 89, 87, 78, 44, 2, 3

See application file for complete search history.

(56) References Cited

U.S. PATENT DOCUMENTS

| | | | | |
|---|---|---|---|---|
| 2,465,360 | A | 3/1949 | Dill | |
| 2,953,876 | A * | 9/1960 | Zieber et al. | 451/2 |
| 3,711,912 | A | 1/1973 | Teske et al. | |
| 5,323,561 | A * | 6/1994 | Yoshikawa et al. | 451/80 |
| 5,490,807 | A * | 2/1996 | Marchell | 451/3 |
| 8,556,683 | B2 * | 10/2013 | Lynn et al. | 451/89 |
| 2006/0108583 | A1 | 5/2006 | Hinkle | |
| 2010/0035522 | A1 * | 2/2010 | Mase et al. | 451/38 |
| 2013/0059500 | A1 * | 3/2013 | Mase | 451/38 |

FOREIGN PATENT DOCUMENTS

| | | |
|---|---|---|
| CN | 101642896 | 2/2010 |
| DE | 93 10 642.4 | 10/1993 |
| EP | 0 569 708 A1 | 11/1993 |
| JP | H0663866 | 3/1994 |
| JP | 2000-150944 | 5/2000 |
| JP | 2007-335791 | 12/2007 |
| JP | 2008-000718 | 1/2008 |
| JP | 2008-100322 | 5/2008 |
| JP | 2010-036323 | 2/2010 |
| JP | 2010-036324 | 2/2010 |

OTHER PUBLICATIONS

Office Action for JP Application No. 2012-531581 dated Nov. 4, 2014.

Chinese Patent Office, "Office Action" issued in Application No. 201110121694.0, dated Jun. 27, 2013, two pages.

International Search Report dated Oct. 17, 2012; Application No. PCT/JP2011/003167; 2 pages.

* cited by examiner

*Primary Examiner* — Robert Rose
(74) *Attorney, Agent, or Firm* — Finnegan, Henderson, Farabow, Garrett & Dunner, L.L.P.

(57) ABSTRACT

The present invention provides an apparatus for removing the unnecessary thin-film layer on the periphery of the substrate of the plate-like member having a square shape, on the surface of which substrate is formed a thin-film layer. The apparatus comprises a chamber to treat the peripheral part where the peripheral part of the plate-like member is inserted and where the unnecessary thin-film layer on the peripheral part of the plate-like member is removed; and a means to move the plate-like member. The chamber to treat the peripheral part comprises a cover to prevent the scattering of the sprayed particles and the dust for treating the peripheral part, the cover having one of its end-sides that forms a ceiling being closed and having the other end-side that is opposed to the ceiling being open and a suctioning cover for treating the peripheral part, having an opening that has the same shape as the opening of the cover to prevent the scattering of the dust. In the chamber to treat the peripheral part, a blasting nozzle for spraying particles for treating the peripheral part is disposed on the cover to prevent the scattering of the dust, so that the mouth of the blasting nozzle is covered by the wall of the cover to prevent the scattering of the sprayed particles and the dust.

32 Claims, 15 Drawing Sheets

(A)

(B)

(C)

(A)

(B)

(A)

(B)

(C)

(A)

(B)

(A)

(B)

(C)

(A)

(B)

(C)

APPARATUS FOR TREATING A PLATE-LIKE MEMBER AND METHOD OF TREATING THE SAME

FIELD OF INVENTION

This invention is directed to an apparatus for treating a plate-like member, wherein the apparatus removes the unnecessary thin-film layer on the peripheral part of the plate-like member that has a thin-film layer formed on the surface of a substrate.

BACKGROUND OF THE INVENTION

When a thin-film layer is formed on the surface of a substrate, the thin-film layer on the periphery of the substrate sometimes is thicker than the thin-film layer formed in the inner part of the substrate. Or sometimes the thin-film layer reaches the reverse side of the substrate.

For example, Patent Document 1 discloses an apparatus that forms a thin-film layer that can be used for a chemical filter or for organic EL wherein the apparatus is designed to prevent a thin-film layer having an uneven thickness from being formed on the periphery of the substrate because of dripping of a liquid during manufacturing, for example, by an immersion dipping, which is one of the wet processes. But to form a thin-film layer that has a completely even thickness is difficult. Therefore, after the thin-film layer is formed in accord with the accuracy in thickness that is required of the thin-film layer formed on the substrate, preferably the thin-film layer is treated by a process that makes the thin film have an even thickness.

Also, a thin-film solar battery panel (hereafter, "solar battery panel") is manufactured by having a layer of transparent electrodes, a semi-conductive layer, a metal layer, etc., laminated on the surface of the substrate of glass, etc. The laminating process is carried out, for example, by a vapor phase reaction, whereby sometimes the thin-film layer goes around the peripheral edge of the substrate and reaches its reverse surface. A solar battery module needs an insulating characteristic. So, to give this characteristic to the solar battery, to remove the thin-film layer on the periphery of the substrate of the thin-film solar battery by a blasting treatment is proposed (Patent Document 2).

In the process of removing the thin-film layer on the periphery of the substrate by the blasting treatment, sometimes the sprayed particles (abrasives), and the dust that is the particles of the thin-film layer, etc., and that is abraded and removed, remain on the solar battery panel. A method of removing the thin-film layer on the periphery of the substrate is proposed in Reference 3 wherein no sprayed particles or dust remain on the substrate.

RELATED DOCUMENTS

Patent Documents

Patent 1: Publication of the Patent application, Publication No. 2008-000718

Patent 2: Publication of the Patent application, Publication No. 2000-150944

Patent 3: Publication of the Patent application, Publication No. 2010-036324

SUMMARY OF THE INVENTION

Problem to be Solved by the Invention

Patent document 3 discloses removing abrasives and dust from both surfaces of the solar battery panels by installing the covers that are connected to a suction means and that cover the surface of the solar battery panel that is to be treated and also its reverse surface. However, if the negative pressures (suctioning force) that work on the surface to be treated and that work on the reverse surface are inadequately balanced, the sprayed particles and the dust cannot be sufficiently recovered. Also, Patent document 3 discloses an embodiment where a dust collector is used as a suctioning means. But the performance of the dust collector changes depending on its use (because if the period of use becomes longer, the sprayed particles and the dust are deposited on the filter). So, to balance the suctioning force on the surface to be treated and that on the reverse surface becomes very difficult, such that the recovery of the sprayed particles and the dust will not be adequately carried out.

Further, the particles that were sprayed from a blasting nozzle collide with the solar battery panel and then bounce back (reflect). If the particles (abrasives) that bounce back collide with, for example, the nozzle, and then bounce back and collide with the solar battery panel, the part of the solar battery panel that is not the periphery of the solar battery panel will be damaged by the sprayed particles, resulting in a drop of photovoltaic power of the solar battery module. Thus the sprayed particles and the dust (sprayed particles that became smaller because they were broken or split, the thin-film layer, etc., that are removed by abrasion) that are produced from the blasting treatment must be recovered before they damage the parts that are not part of the periphery of the solar battery panel.

Further, about an apparatus for treating a plate-like member (hereafter, a "blasting apparatus"), the treatment of the entire surface of the substrate is carried out by either a blasting nozzle for spraying particles or a workpiece being moved. Very often the method to move the workpiece is selected based on the cost of the investment in the blasting apparatus. But this method tends to cause the particles that are sprayed from the blasting nozzle to adhere to the transporting device that carries the workpiece (solar battery panel), such that sometimes the solar battery panel is damaged when it is brought into contact with the sprayed particles that adhere to the transporting device.

In view of these problems, the present invention aims to provide an apparatus that produces the substrate of a plate-like member that has a unnecessary thin-film layer on the periphery of the substrate removed from the surface of the substrate on which the thin-film layer is formed.

In the present invention, unless otherwise specified the term "to remove the unnecessary thin-film layer" refers not only to completely removing the thin-film layer from the surface of the substrate but also to removing a part of the surface of the thin-film layer so as to adjust the difference in the thickness of the thin-film layer produced between the periphery and the center portion of the substrate when the thin-film layer is produced as described in the process discussed in Paragraph 0003.

Means to Solve the Problem

The present invention provides an apparatus for removing the unnecessary thin-film layer on the periphery of the substrate of the plate-like member having a square shape, on the surface of which substrate is formed a thin-film layer. The apparatus for removing the unnecessary thin-film layer comprises a chamber to treat the peripheral part where the peripheral part of the plate-like member is inserted and where the unnecessary thin-film layer on the peripheral part of the plate-like member is removed; and a means to move the plate-like member relative to the blasting nozzle for spraying particles that is disposed in the chamber to treat the peripheral part, wherein the chamber to treat the peripheral part comprises:

a cover to prevent the scattering of the sprayed particles and the dust for treating the peripheral part, the cover having one of its end-sides that forms a ceiling being closed and having the other end-side, which is opposed to the ceiling, being open;

a blasting nozzle for spraying particles, which nozzle carries out the blasting treatment by spraying the particles on the surface of the workpiece (hereafter, the "work (W)"), the blasting nozzle for spraying particles for treating the peripheral part being disposed on the cover to prevent the scattering of the sprayed particles and the dust, so that the mouth of the blasting nozzle is covered by the wall of the cover to prevent the scattering of the sprayed particles and the dust;

a suctioning cover for treating the peripheral part, having an opening that has the same shape as the opening of the cover to prevent the scattering of the sprayed particles and the dust;

a suctioning member for treating the peripheral part, which member has a hollow center, having both end-sides being kept open and the end-sides each communicating with the suctioning cover for treating the peripheral part and a suctioning means;

wherein the cover to prevent the scattering of the sprayed particles and the dust for treating the peripheral part and the suctioning cover for treating the peripheral part form a structure where their openings communicate with each other, the structure being built in a way that the peripheral part of the work (W) can be inserted in the structure and wherein, when the peripheral part is inserted, an opening in the structure allows gaps to be formed, at the open end sections of the chamber to treat the peripheral part, between the chamber to treat the peripheral part and the surface of the plate-like member to be treated, and also between the chamber to treat the peripheral part and the reverse surface of the plate-like member, through which gaps outside air can be introduced (the first invention).

Also, the apparatus for treating a plate-like member of the first invention can be constituted in such a way that the blasting nozzle for spraying particles for treating the peripheral part and the plate-like member forms an angle of 30 to 70 degrees when the plate-like member is inserted into the opening (the second invention).

Also, the apparatus for treating a plate-like member of the first invention can comprise a guide plate at least at one of the open end sections of the opening of the chamber to treat the peripheral part so as to have the outside air introduced through the openings (the third invention).

Also, the apparatus for treating a plate-like member of the first invention comprise two chambers to treat the peripheral part wherein the chamber to treat the peripheral part is each disposed on each of the two parallel sides on peripheral parts of the plate-like member which is placed flat (the fourth invention).

Also, the apparatus for treating a plate-like member of the fourth invention can comprise the chambers to treat the peripheral part that are disposed in such a way that the line connecting the two chambers is parallel to the two parallel sides of the plate-like member other than those parallel sides of the peripheral parts that are to be treated (the fifth invention).

Also, the apparatus for treating a plate-like member of the fourth invention can comprise at least one chamber to treat the inner part of the plate-like member that is disposed between the parallel sides on the peripheral parts of the plate-like member that are to be treated. The chamber to treat the inner part of the plate-like member treats the inner part in a way such that the treated inner part is parallel to the parallel peripheral sides of the plate-like member that are to be treated (the sixth invention).

The chamber to treat the inner part of the plate-like member of the sixth invention can comprise a hollow suctioning cover for treating the inner part, the suctioning cover having one end-side that forms a ceiling being closed and having the other end-side that opposes the ceiling being open;

a blasting nozzle for spraying particles for treating the inner part of the surface to be treated by spraying particles, the blasting nozzle for spraying particles being disposed on the suctioning cover for treating the inner part in such a way that the mouth of the nozzle is covered by the side walls of the suctioning cover for treating the inner part, and a suctioning member for treating the inner part, both end-sides of which member are open and communicate with the suctioning cover for treating the inner part and the suctioning means, respectively, wherein a gap can be provided between the open end section of the suctioning cover and the surface of the work (W) so that the outside air can be suctioned through it (the seventh invention).

The blasting nozzle for spraying particles for treating the inner part of the seventh invention can be disposed at the rear of the suctioning member for treating the inner part in the direction of the movement of the plate-like member relative to the blasting nozzle for spraying particles. Also, the suctioning member for treating the inner part can be disposed ahead of and above the blasting nozzle for spraying particles in the direction of the movement of the plate-like member relative to the blasting nozzle for spraying particles (the eighth invention).

The blasting nozzle for spraying particles for treating the inner part of the eighth invention can be disposed in such a way that the angle between the blasting nozzle and the plate-like member is 30-75 degrees (the ninth invention).

On the side wall of the suctioning cover for treating the inner part as in the eighth invention is disposed an auxiliary suctioning member that communicates with the suctioning means, whereby the auxiliary suctioning member can be disposed on the side wall of the suctioning cover for treating the inner part, which side wall is ahead of the blasting nozzle for spraying particles in the direction of the movement of the plate-like member relative to the blasting nozzle for spraying particles (the tenth invention).

A guide member that introduces the outside air can be disposed at the open end section of the suctioning cover for treating the inner part as in the seventh invention (the eleventh invention).

At least one of the mouths of the blasting nozzles for treating the peripheral part and the mouth of the blasting nozzle for treating the inner part of the apparatus for treating a plate-like member as in the first or the seventh invention can have a rectangular shape (twelfth and thirteenth inventions).

At least one of the blasting nozzles for treating the peripheral part and the blasting nozzle for treating the inner part as in the twelfth invention can comprise a main body of the blasting nozzle for spraying particles; an air nozzle that introduces compressed air into the inside of the main body of the blasting nozzle and that produces negative pressure in the main body of the blasting nozzle for spraying particles; and a spraying section that comprises a mouth of the nozzle, from which the particles that are suctioned into the inside of the main body of the blasting nozzle by the negative pressure and that are mixed with the compressed air in the mixing chamber within the main body of the blasting nozzle are sprayed (the fourteenth invention).

The chamber to treat the peripheral part as in the first or fourth invention can have one or more adjoining cleaning chambers to treat the peripheral part. The cleaning chamber suctions the sprayed particles attached to the surface of the work (W) and the dust produced by the blasting treatment (the fifteenth invention).

The cleaning chamber to treat the peripheral part as in the fifteenth invention comprises a suctioning cover for cleaning the peripheral part, the suctioning cover having a hollow center, and having one of its end-sides that forms the ceiling being closed and having the other end-side that is opposed to the ceiling being open; an air-blowing nozzle for cleaning the peripheral part, the air-blowing nozzle separating and removing the sprayed particles and the dust attached to the surface of the work (W) by blowing the compressed air on the surface, the air-blowing nozzle being disposed on the suctioning cover in such a way that the mouth of the nozzle is covered by the walls of the suctioning cover for cleaning the peripheral part; and a suctioning member for cleaning the peripheral part, the suctioning member having both end-sides being kept open and the end-sides communicating with the suctioning cover for cleaning the peripheral part and a suctioning means, respectively, wherein a gap can be provided between the open end section of the suctioning cover and the surface of the work (W) so that the outside air can be suctioned through it (the sixteenth invention).

A guide member that introduces the outside air can be disposed at the open end section of the cleaning chamber to treat the peripheral part as in the sixteenth invention (the seventeenth invention).

The chamber to treat the inner part as in the sixth invention can comprise an adjoining cleaning chamber to treat the inner part, which cleaning chamber suctions and recovers the sprayed particles and the dust that are produced by the blasting treatment and that are attached to the surface of the work (W) (the eighteenth invention).

The cleaning chamber to treat the inner part as in the eighteenth invention can comprise:

a suctioning cover for cleaning the inner part, the suctioning cover having a hollow center, and having one of its end-sides that forms the ceiling being closed and having the other end-side that is opposed to the ceiling being open;

an air-blowing nozzle for cleaning the inner part, the air-blowing nozzle separating and removing the sprayed particles and the dust attached to the surface of the work (W) by blowing the compressed air on the surface of the work (W), the air-blowing nozzle for cleaning the inner part being disposed on the suctioning cover in such a way that the mouth of the nozzle is covered by the walls of the suctioning cover for cleaning the inner part; and a suctioning member for cleaning the inner part, having both end-sides being kept open and the end-sides communicating with the suctioning cover for cleaning the inner part and the suctioning means, respectively, wherein a gap can be provided between the open end section of the suctioning cover and the surface of the work (W) so that the outside air can be suctioned through it (the nineteenth invention).

The cleaning chamber to treat the inner part as in the nineteenth invention can comprise, at the open end section of the cleaning chamber to treat the inner part, a guide member that introduces the outside air (the twentieth invention).

The means to move a plate-like member as in the first invention can comprise a transfer mechanism that carries the plate-like member on it and moves the plate-like member in the process of the treatment (the twenty-first invention).

The apparatus for treating a plate-like member of any one of the first, fourth, sixth, fifteenth, nineteenth, and twenty-first inventions can comprise a device to turn the plate-like member, of which the peripheral part has already been treated, by about 90 degrees (the twenty-second invention).

The apparatus for treating a plate-like member of any one of the first, fourth, sixth, fifteenth, nineteenth, and twenty-first inventions can comprise a means to carry in the plate-like member to the area where the peripheral part of the plate-like member is treated, wherein the means to carry in the plate-like member can comprise rollers for transport made of urethane foam having a structure that includes separated air bubbles (the twenty-third invention).

The means to carry in the plate-like member as in the twenty-third invention can comprise a means to determine the position to stop (positioning means) where the plate-like member that was transferred is to stop (the twenty-fourth invention).

The means to determine the position to stop of the apparatus for treating a plate-like member as in the twenty-fourth invention can comprise a means to determine a position in the direction of the transport (hereafter, "transporting direction") of the plate-like member, which means determines the position to stop the plate-like member in the transporting direction. The means to determine the position to stop in the transporting direction can comprise at least one member for determining the position in the transporting direction of the plate-like member, having a cylindrical shape, the positioning means being disposed perpendicular to the transporting direction of the plate-like member (the twenty-fifth invention).

The transporting direction refers to the direction that the work (W) (plate-like member) moves from the means to carry in the work (W) to the means to carry out the work (W) in FIG. 14 B (from left to right).

The means to determine the position to stop of the apparatus for treating a plate-like member as in the twenty-fifth invention can further comprise a means to determine the position in the direction perpendicular to the transporting direction of the plate-like member (hereafter, "perpendicular direction"), which means determines the position to stop on the side to be treated of the work (W), the means to determine the position in the perpendicular direction comprising at least one member for determining the position to stop in the perpendicular direction, having a cylindrical shape (the twenty-sixth invention).

The apparatus for treating a plate-like member as in the twenty-third invention comprises a means to carry out the plate-like member, which means carries out the plate-like member out of the area where and when the treatment of the peripheral part the plate-like member is complete, wherein the means to carry out the plate-like member can comprise rollers for transport made of urethane foam having a structure that includes separated air bubbles (the twenty-seventh invention).

The apparatus for treating a plate-like member of any one of the first, fourth, sixth, fifteenth, nineteenth, and twenty-first inventions can manufacture from the plate-like member that is to be treated by the apparatus a solar battery panel that has a thin-film layer, for example, transparent electrode layer, optical semiconductor layer, metal layer, etc., that are required to form a solar battery panel, formed on the surface of the translucent substrate, such as glass, etc. (the twenty-eighth invention).

A method of treating a plate-like member of any one of the first, fourth, sixth, fifteenth, nineteenth and twenty-first inventions can comprise steps of:

inserting the peripheral part of the plate-like member, which is a work (W) to be treated, into the gap;

spraying the particles from the blasting nozzle for spraying particles for treating the peripheral parts;

removing the unnecessary thin-film layers on the surface of the work (W) with the sprayed particles; and suctioning the sprayed particles and the dust that are produced by the blasting treatment (twenty-ninth invention)

The method of treating the plate-like member as in the twenty-ninth invention comprises steps of:

moving the plate-like member is moved in such a direction that the peripheral part of the plate-like member is inserted into the gap whereby removing the unnecessary thin film layer on the peripheral part of the side first to be treated of the plate-like member;

turning the plate-like member, of which the treatment of the side first to be treated is completed, by about 90 degrees and moving the plate-like member to the position where the treatment starts; and moving the plate-like member in such a direction that the peripheral part of the plate-like member is inserted into the gap, whereby removing the unnecessary thin film layer on the side adjacent to the side first to be treated of the plate-like member is carried out (thirtieth invention).

The Effect of the Invention

An unnecessary thin-film layer on the work (W) (the work (W) is a plate-like member of a square-shape substrate, on which surface is formed a thin-film layer) is removed by the blasting treatment, wherein the particles are sprayed from the blasting nozzle for spraying particles onto the peripheral part of the work (W) that is inserted into the chamber to treat the peripheral part. The sprayed particles and the dust that is made up of the unnecessary thin-film layer, etc., that are removed by the blasting treatment (hereafter, collectively called "dust") do not scatter outside the chamber to treat the peripheral part, because they are prevented from leaking out from the chamber by the cover to prevent the scattering of the sprayed particles and the dust and the suctioning cover for treating the peripheral part. The sprayed particles and the dust is suctioned and recovered by the suctioning means, which communicates with the suctioning cover. Also, because of the gap formed between the open end sections of the opening of the chamber to treat the peripheral part and the work (W), the open end sections of the opening facing the surface to be treated of the work (W), and the reverse surface do not contact the work (W), such that suctioning and recovering the sprayed particles and the dust are effectively carried out while the outside air is being introduced through the gap (the first and twenty-ninth inventions). Also, the blasting nozzle for spraying particles is disposed in a way that it is inclined at an angle of 30-75 degrees against the work (W). Also, the mouth of the nozzle is disposed in a way that it faces the peripheral parts of the work (W), such that the particles sprayed from the mouth of the blasting nozzle for spraying particles move smoothly toward the suctioning means. Also, damage to the untreated inner parts of the work (W) caused by the sprayed particles is prevented (the second invention).

By having the chambers to treat the peripheral part placed along the two parallel sides (sides to be treated) of the work (W) and having the work (W) move relative to the blasting nozzle for spraying particles to treat the peripheral part by the means to move the work (W), the two sides can be simultaneously treated. The means to move the work (W) can be designed in such a way that it moves either the chamber to treat the peripheral part or the work (W). But the apparatus can have a simpler structure if it is designed in a way that the work (W), not the chamber to treat the peripheral part, is moved (the twenty-first invention). Also, the chambers to treat the peripheral part can be disposed in such a way that the line that connects two chambers forms a line parallel to the sides that are perpendicular to the sides to be treated (that is, an imaginary line [see FIG. 17] that connects the centers of the mouths of the blasting nozzles for spraying particles) forms a line parallel to the sides that are perpendicular to the sides of the peripheral parts to be treated (the fourth and fifth inventions). Also, the apparatus for treating a plate-like member of the present invention can perform similar treatments on the other two sides of the plate-like member after turning the work (W), of which the two sides have already had the treatment, completed, by 90 degrees relative to the blasting nozzle for spraying particles. Thus all four sides of the peripheral parts can be treated (the twenty-second and thirtieth inventions).

If a plurality of works (W), each having the thin-film layer on the peripheral parts removed, are to be obtained from a large scale work (W), by the large scale work (W) being cut into the plurality of the works (W), a means to cut the large scale work (W) into the plurality of works (W) can be used after the thin-film layer on the peripheral parts of the large scale work (W) and on the parts (inner parts) that would become the peripheral parts of each of the plurality of works (W) are treated.

So as to remove the unnecessary thin-film layer in the inner part, a chamber to treat the inner part can be disposed between the parallel sides that are to be treated. The unnecessary thin-film layer is removed by the particles sprayed from the blasting nozzle for spraying particles for treating the inner parts. The sprayed particles and the dust do not scatter outside the chamber to treat the inner part, because they are prevented from leaking out of the chamber to treat the inner part by the suctioning cover for treating the inner part. The sprayed particles and the dust are suctioned by the suctioning means that communicates with the suctioning cover. Also, because of the gaps formed between the open end sections of the suctioning cover for treating the peripheral part and the work (W), the suctioning cover for treating the peripheral part does not contact the work (W). Thus suctioning and recovering the sprayed particles and the dust are effectively carried out while the outside air is being introduced through the gap (the sixth and seventh inventions). Also, by having the suctioning member for treating the inner part disposed ahead of and above the work (W) in the transporting direction of the work (W) and having the blasting nozzle disposed in the rear of the suctioning member in the transporting direction, the particles sprayed by the blasting nozzle that collide with the work (W) or that remain on the work (W) pass directly below or near the suctioning member. So, the sprayed particles are efficiently suctioned and recovered (the eighth invention). Further, if the angle between the blasting nozzle and the work (W) is set at 30-75 degrees and if the auxiliary suctioning member is disposed on the front wall, the suctioning and recovery will more effectively be carried out (the ninth and tenth invention).

A wider area can be treated at a time if the shape of the mouth of the blasting nozzle for spraying particles for treating the inner part is rectangular $$(\text{width}(X_w) \geq \text{length}(X_L)),$$

compared with the area that is treated if the shape of the mouth is circular. Further, if the transporting direction of the work (W) is the same as the direction of the length of the mouth of the blasting nozzle, a wider area can be treated at a time (the twelfth and thirteenth inventions).

Also, the nozzle that has a structure as in the fourteenth invention can treat the work (W) continuously, without any complex auxiliary equipment being added.

The sprayed particles and the dust that are not removed and that are left on the work (W) that passed through the chamber to treat the peripheral part can be separated from the work (W) by the compressed air blown from the nozzle (air-blowing). If the cleaning chamber to treat the peripheral part, which chamber has the air-blowing nozzle for cleaning the peripheral part, is disposed next to the chamber to treat the peripheral part, the sprayed particles and the dust can be separated from the work (W) by the compressed air that is blown from the air-blowing nozzle. The sprayed particles and the dust that are separated do not scatter outside the cleaning chamber, because they are prevented from leaking out of the cleaning chamber by the suctioning cover for cleaning the peripheral part. The sprayed particles and the dust are suctioned by the suctioning means that communicates with the suctioning cover. Also, because of the gaps formed between the open end sections of the suctioning cover and the work (W), the open end sections of the suctioning cover do not contact the work (W). So, suctioning and recovering the sprayed particles and the dust are effectively carried out while the outside air is being introduced through the gaps (the fifteenth and sixteenth inventions).

Similarly, if the sprayed particles and the dust remain on the work (W) that passed through the chamber to treat the inner part, then having the cleaning chamber to treat the inner part disposed next to the chamber to treat the inner part, the sprayed particles and the dust can be separated from the work (W). Then they are suctioned and recovered without being scattered outside the cleaning chamber (the eighteenth and nineteenth inventions).

The chamber to treat the peripheral part, the chamber to treat the inner part, the cleaning chamber to treat the peripheral part, and the cleaning chamber to treat the inner part, each by having a guide member provided at the open end sections, can smoothly introduce the outside air. As a result it facilitates the flow of the sprayed particles and the dust, such as thin-film, etc., that are removed and separated, for the suctioning means, and suctioning and recovering the sprayed particles and the dust are effectively carried out (the third, eleventh, seventeenth, and twentieth inventions).

By having the means to carry in the work (W), which means carries the work (W) to the area where the chamber to treat the peripheral part and the chamber to treat the inner part to treat the work (W) and by having the means to carry out the work (W) that has its treatment completed the out of the area be provided, a continuous and automatic treatment of the work (W) can be carried out. If the means to carry in and to carry out the work (W) adopt a structure that uses the rollers for transport, they can transport the work (W) by a simple mechanism. If the sprayed particles and the dust are attached to the rollers, the work (W) may be damaged by them when the work (W) is transported. So, if the rollers are made up of the urethane foam having a structure that includes separated air bubbles, the work (W) will not be damaged during the transport (twenty-third and twenty-seventh inventions). Also, the means to carry in the work (W) and the means to carry out the work (W)), if each are provided with a means to determine the position to stop, which means determines the position where the work (W) that is transported is to stop, can help effect a continuous and stable treatment (twenty-fourth invention). The means to determine the position to stop is preferably disposed in a manner as in the twenty-fifth and twenty-sixth inventions.

The plate-like member to be treated by the apparatus for treating a plate-like member can suitably be treated in a way that unnecessary thin-film layers on the peripheral part and inner part of a thin film solar battery panel are removed from a solar battery panel that has a thin-film layer, that is required to form a solar battery panel, formed on the surface of the translucent substrate, such as glass, etc. such that the solar battery panel can be obtained where the thin-film layer on one surface of the plate-like member is insulated from the other side of the surface (the twenty-eighth invention).

The term "plate-like member of a quadrangle" refers to a plate-like member having a shape of a square or rectangle. The term includes ones that have a minor deformation in shape caused during manufacturing.

BRIEF DESCRIPTION OF DRAWINGS

FIG. 1 (A) is front view and FIG. 1 (B) is a plan view in A-direction in FIG. 1 (A), and FIG. 1(C) is a frame format that shows the structure.

FIG. 2 (A) is a plan view where the work (W) is inserted, FIG. 2 (B) is a cross-sectional view at the line A-A in FIG. 2 (A), and FIG. 2 (C) is an enlarged view of the open end section shown in FIG. 2 (B).

FIG. 3 (A) is a frame format showing the blasting nozzle disposed at an angle of 90 degrees against the work (W). FIG. 3 (B) is a frame format showing the blasting nozzle disposed at an angle of theta(=θ)*a* degrees against the work (W).

Figure 4:
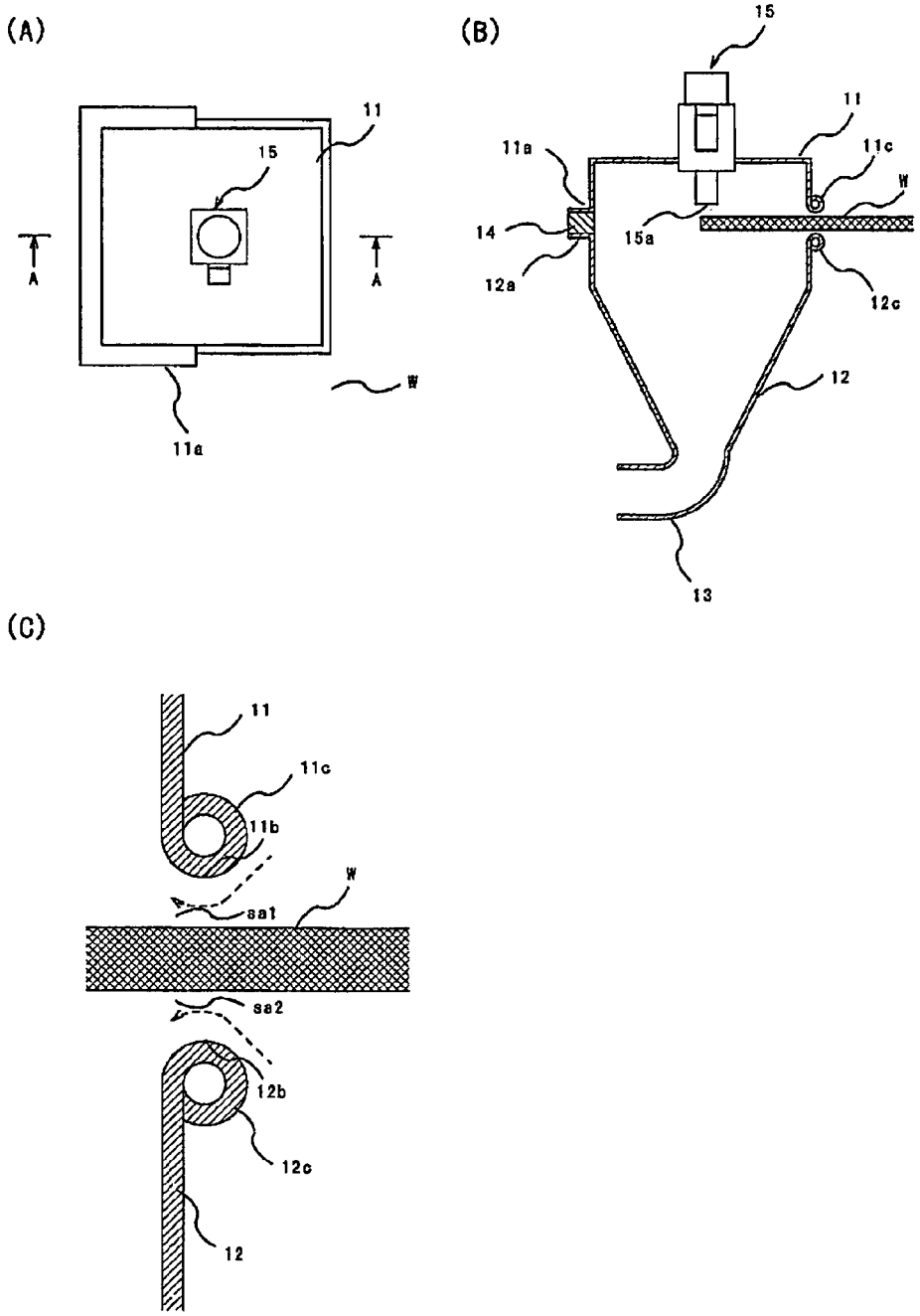

FIG. 4 is an illustration in one embodiment of the guide member of the chamber to treat the peripheral part. FIG. 4 (A) is a plan view, FIG. 4 (B) is a cross-sectional view at the line A-A in FIG. 4 (A), and FIG. 4 (C) is an enlarged view of the open end section shown in FIG. 4 (B).

Figure 5:
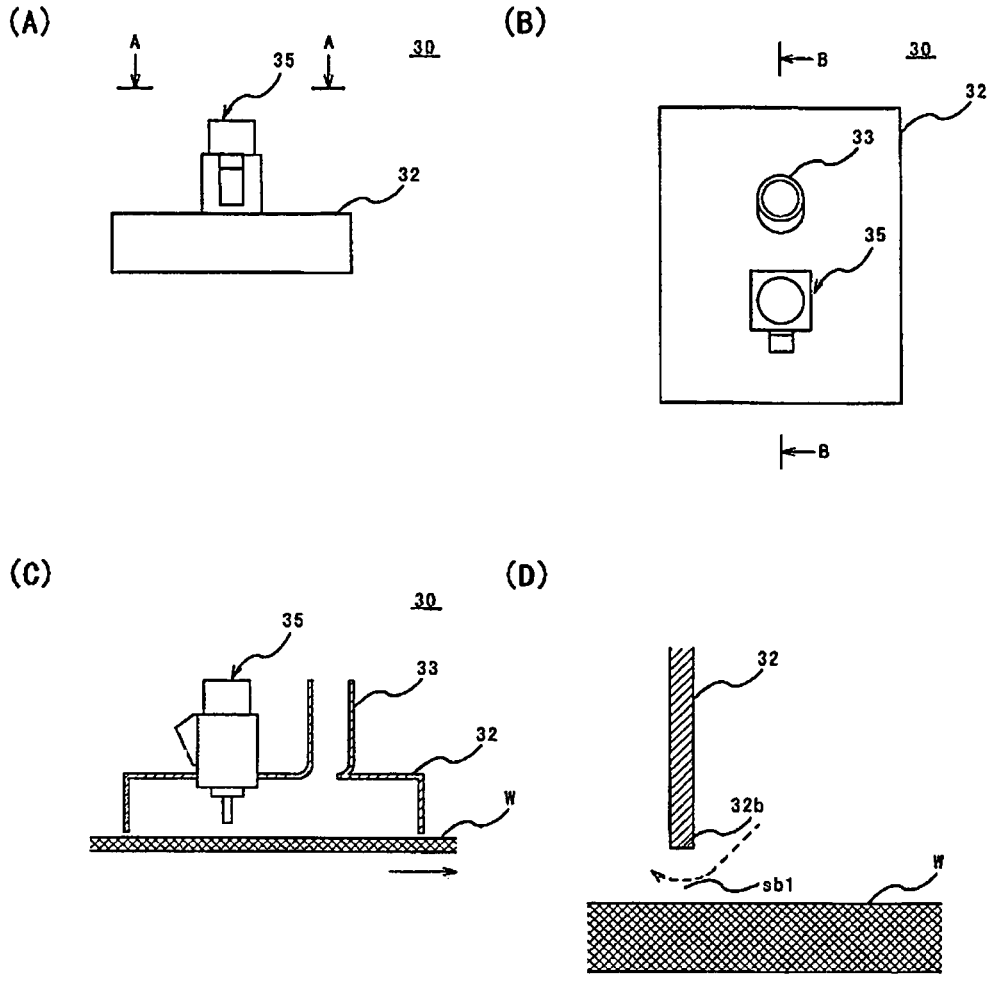

FIG. 5 is an illustration in one embodiment of the chamber to treat the inner part. FIG. 5 (A) is a front view, FIG. 5 (B) is a plan view in the direction of A in FIG. 5 (A), FIG. 5 (C) is a right side view in the direction of B in FIG. 5 (A), and FIG. 5 (D) is an enlarged view of the open end section shown in FIG. 5 (C).

Figure 6:
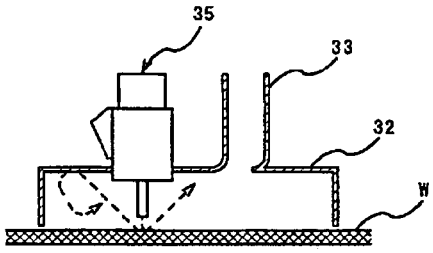
Figure 6:
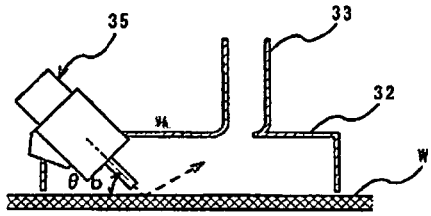
Figure 6:
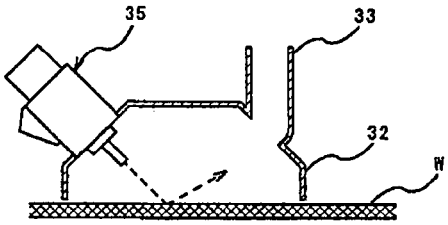

FIG. 6 is an illustration in one embodiment of the arrangement of the blasting nozzle for spraying particles for treating the inner part. FIG. 6 (A) is a frame format showing the blasting nozzle disposed at an angle of 90 degrees against the work (W). FIG. 6 (B) is a frame format showing the blasting nozzle disposed at an angle of theta b degrees against the work (W), and FIG. 6 (C) is an illustration of a frame format of the arrangement of the blasting nozzle for spraying particles for treating the inner part.

Figure 7:
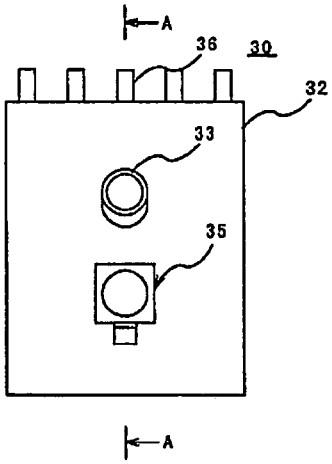
Figure 7:
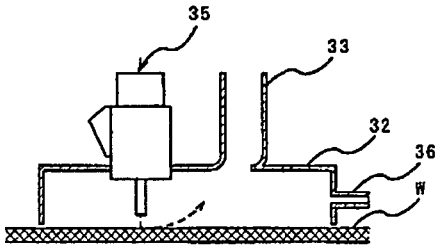

FIG. 7 is an illustration in one embodiment of the auxiliary suctioning member of the chamber to treat the inner part. FIG. 7 (A) is a plan view and FIG. 7 (B) is a cross-sectional view at the line A-A in FIG. 7 (A).

Figure 8:
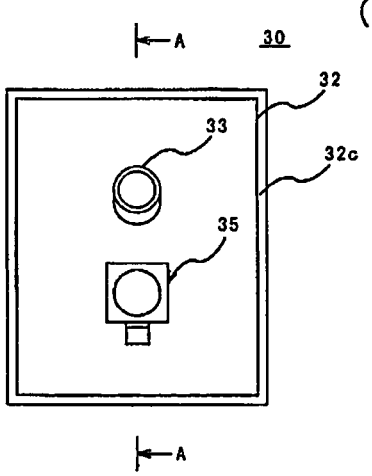
Figure 8:
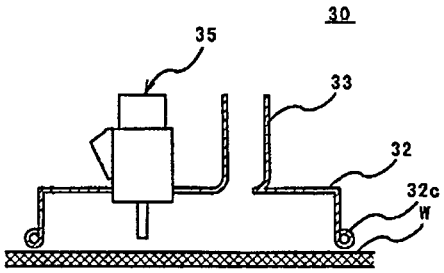
Figure 8:
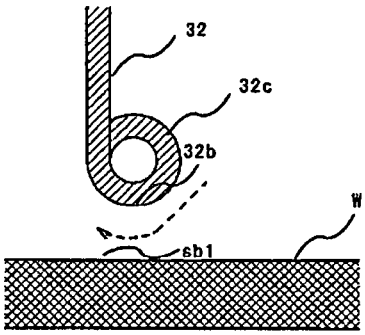

FIG. 8 is an illustration in one embodiment of the guide member of the chamber to treat the inner part. FIG. 8 (A) is a plan view, FIG. 8 (B) is a cross-sectional view at the line A-A in FIG. 8 (A), and FIG. 8 (C) is an enlarged view of the open end section shown in FIG. 8 (B).

Figure 9:
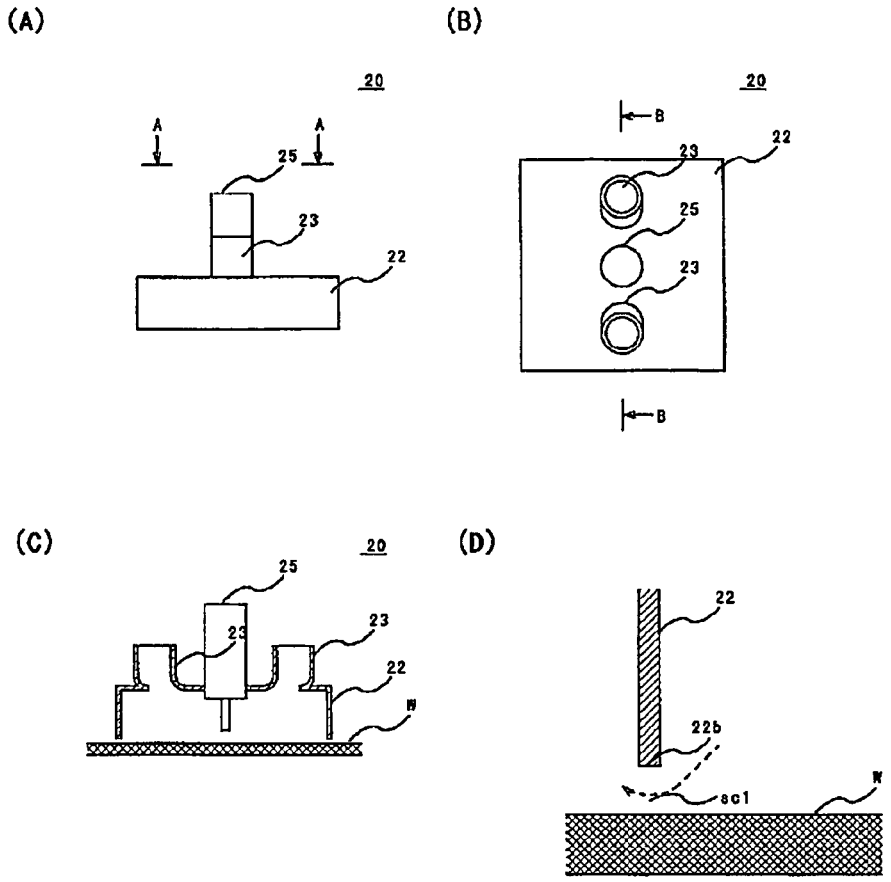

FIG. 9 is an illustration in one embodiment of the cleaning chamber to treat the peripheral part. FIG. 9 (A) is a front view, FIG. 9 (B) is a plan view in the direction of A in FIG. 9 (A), FIG. 9 (C) is a cross-sectional view at B-B line in FIG. 9 (B), and FIG. 9 (D) is an enlarged view of the open end section of FIG. 9 (C).

Figure 10:
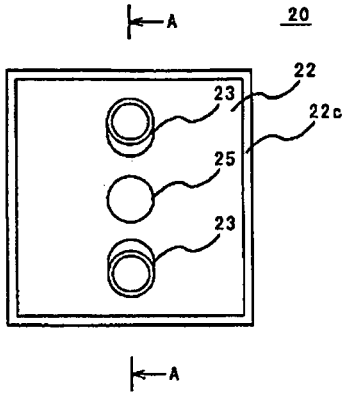
Figure 10:
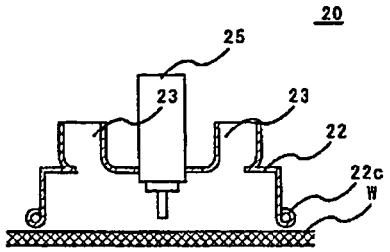
Figure 10:
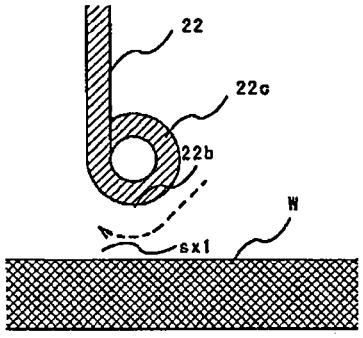

FIG. 10 is an illustration in one embodiment of the guide member of the cleaning chamber to treat the peripheral part. FIG. 10 (A) is a front view, FIG. 10 (B) is a cross-sectional view at A-A line in FIG. 10 (A), and FIG. 10 (C) is an enlarged view of the open end section shown in FIG. 10 (B).

Figure 11:
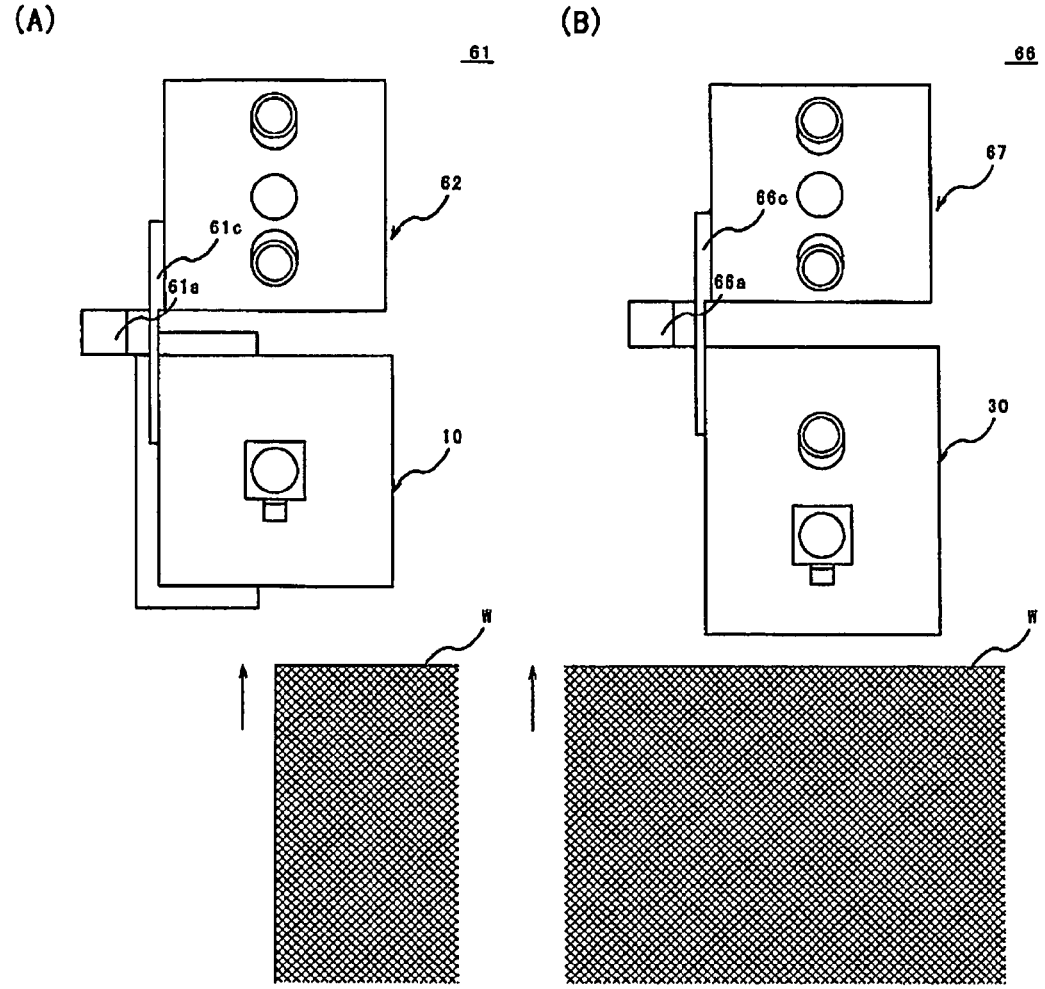

FIG. 11 is an illustration of one embodiment of the chamber to treat the peripheral part and the chamber to treat the inner part, each adjoined by a cleaning chamber. FIG. 11 (A) is a frame format showing the chamber to treat the peripheral part adjoined by the cleaning chamber to treat the peripheral part (a unit to treat the peripheral part) and FIG. 11 (B) is a frame format showing the chamber to treat the inner part adjoined by the cleaning chamber to treat the inner part (a unit to treat the inner part).

Figure 12:
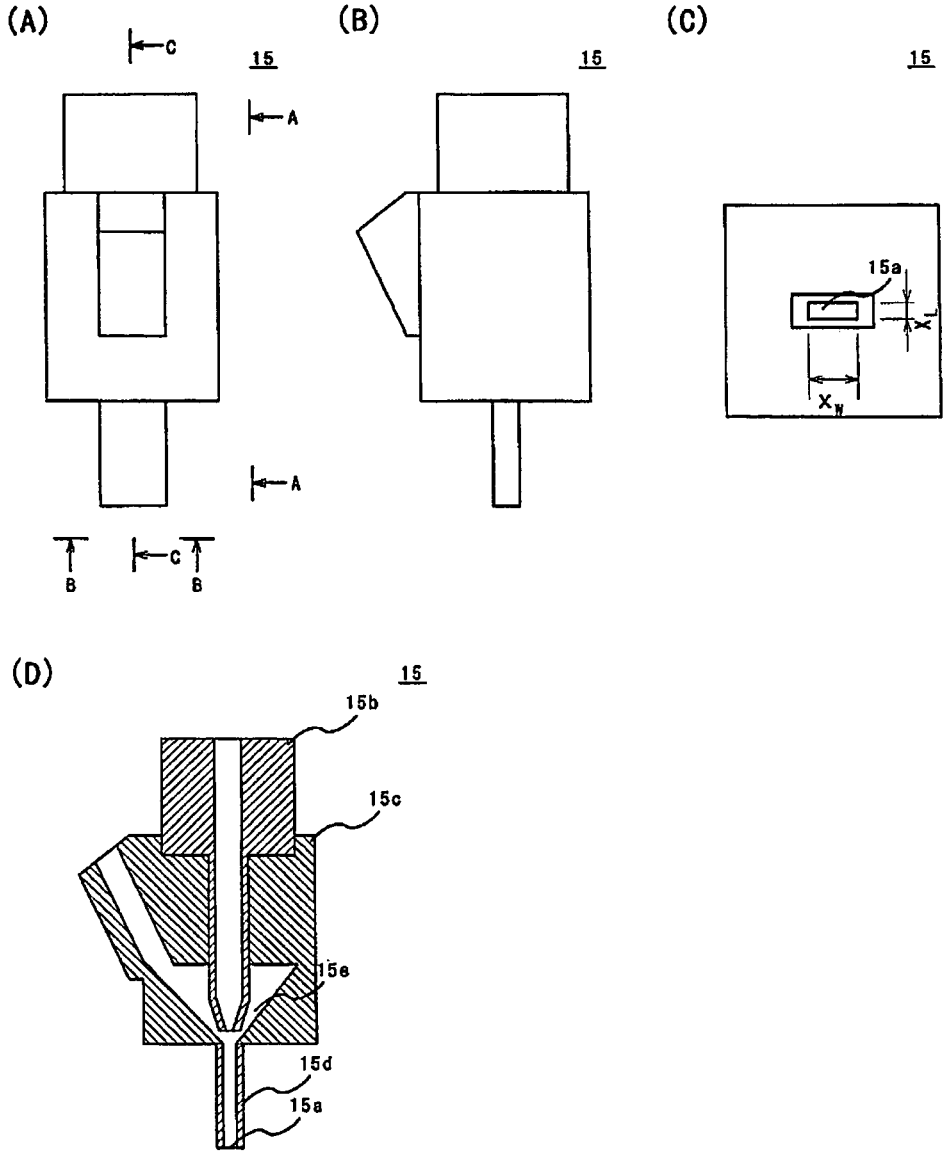

FIG. 12 is an illustration of one embodiment of the blasting nozzle for spraying particles. FIG. 12 (A) is a front view, FIG. 12 (B) is a side view as seen from line A-A in FIG. 12 (A), FIG. 12 (C) is a base view as seen from line B-B in FIG. 12 (A), and FIG. 12 (D) is a cross-sectional view at C-C line in FIG. 12 (A).

Figure 13:
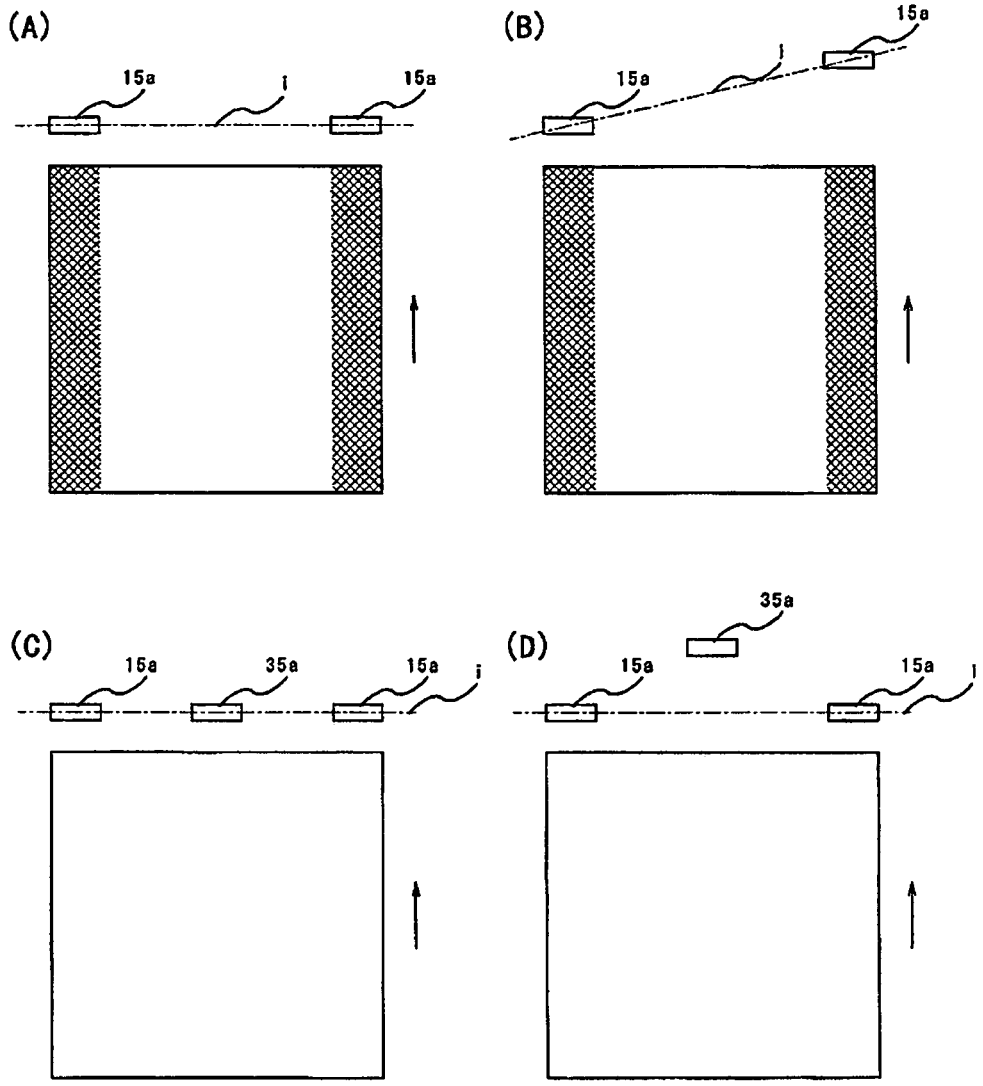

FIG. 13 is an illustration in one embodiment of the relationship of the positions between the mouth of the blasting nozzle for spraying particles (opening) and the work (W). FIGS. 13 (A) and (B) are schematic views where the blasting nozzles for spraying particles (to treat the peripheral part) are positioned above the two parallel sides of the plate-like member that are treated and FIGS. 13 (C) and (D) are schematic views where the blasting nozzle for spraying particles (to treat the inner part) is positioned between the pair of the two blasting nozzles for spraying particles to treat the peripheral part.

Figure 14:
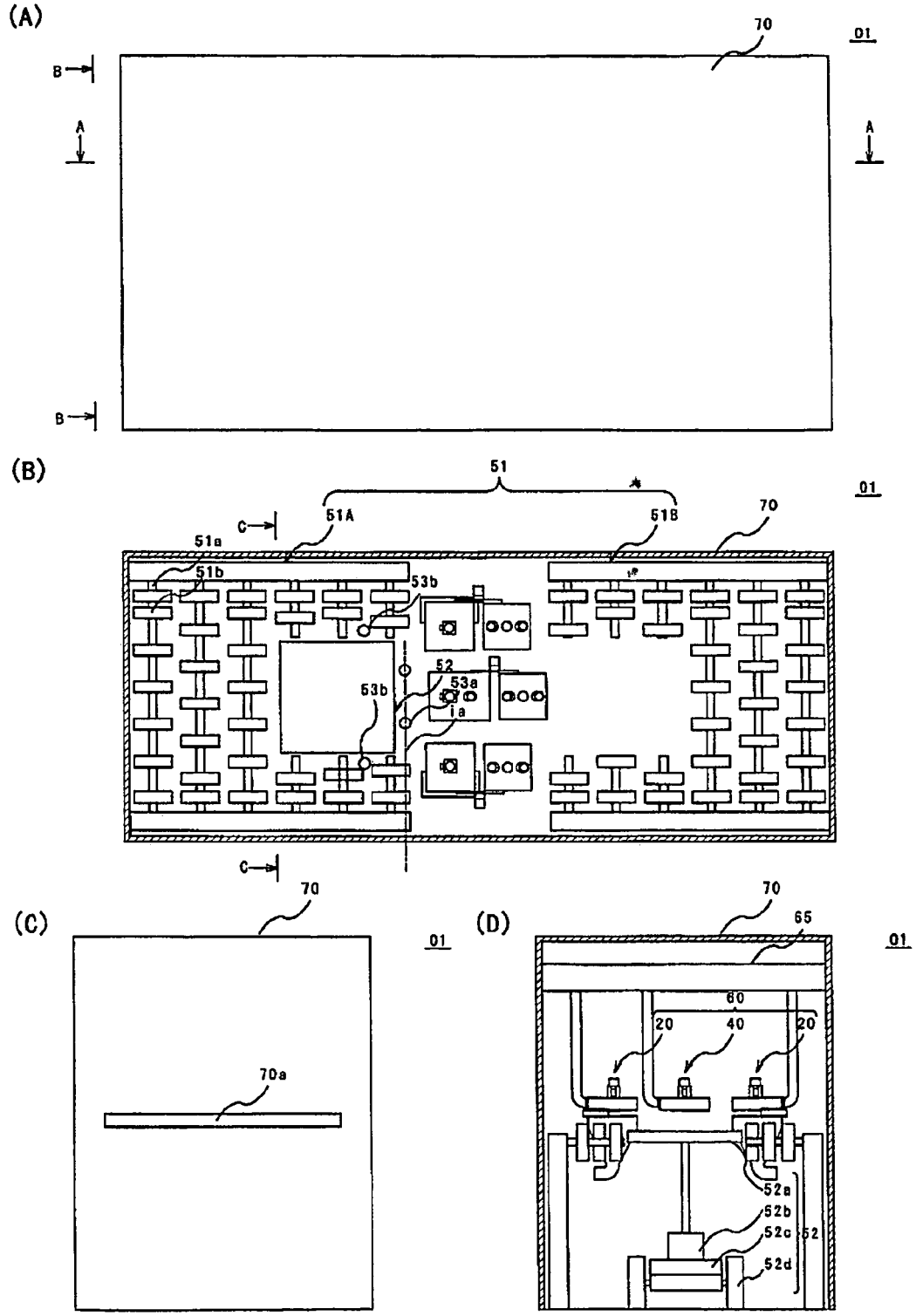

FIG. 14 is an illustration in one embodiment of the apparatus for treating a plate-like member. FIG. 14 (A) is a front view and FIG. 14 (B) is a cross-sectional view at line A-A in FIG. 14 (A). FIG. 14 (C) is a side view as seen from line B-B in FIG. 14 (A). FIG. 14 (D) is a cross-sectional view at line C-C in FIG. 14 (B).

Figure 15:
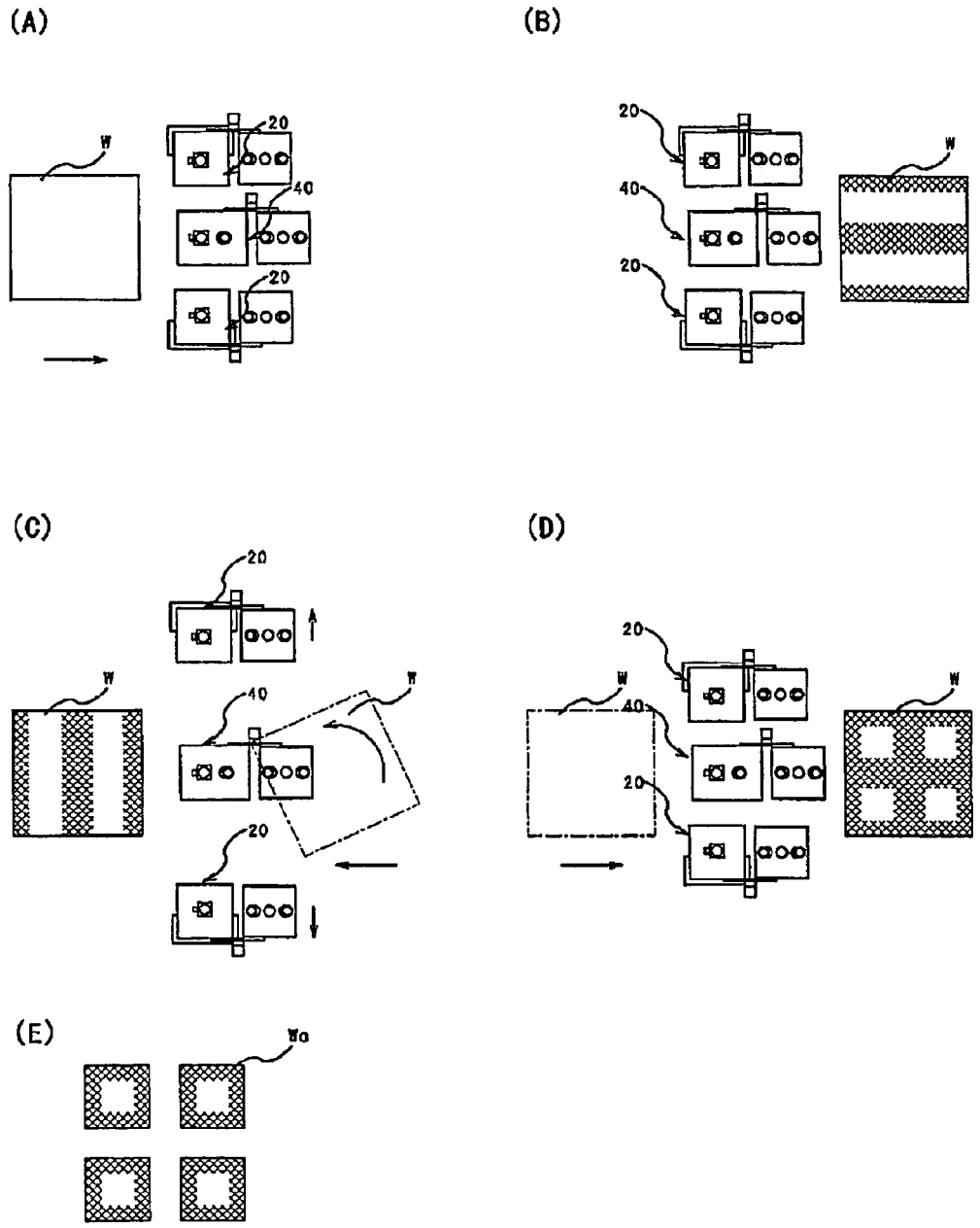

FIG. 15 shows illustrations of embodiments of the treatments.

Figure 16:
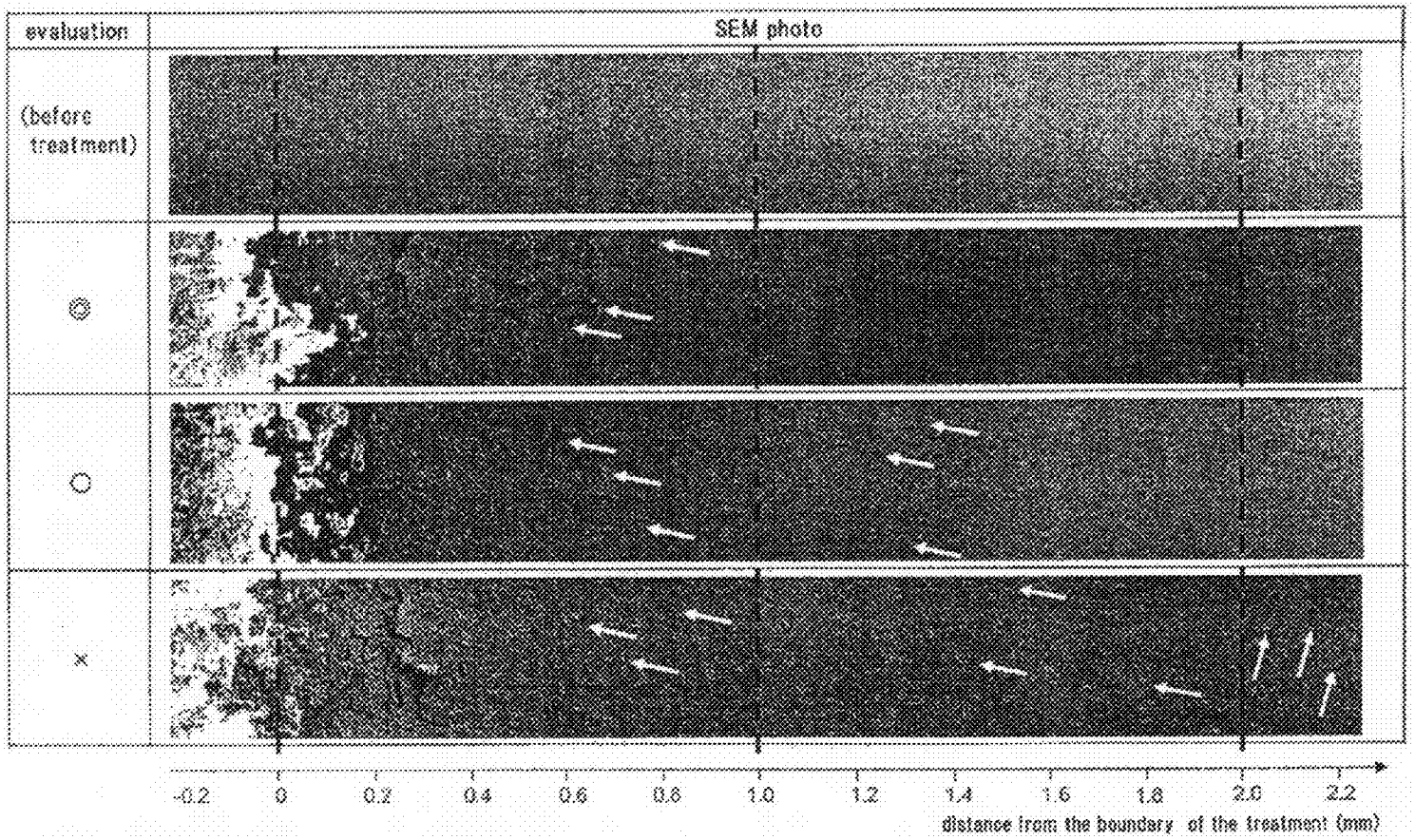

FIG. 16 is an illustration in one embodiment of the apparatus for treating a plate-like member.

ONE EMBODIMENT TO CARRY OUT THE INVENTION

One example of carrying out the present invention is explained below, where a plate-like member that is a thin film solar battery panel, is treated. As explained above, in the thin film solar battery panel, the thin-film layer on the peripheral part of the substrate, such as glass, etc., must be completely removed, so that the surface where a thin film layer is formed is insulated from the reverse surface of the substrate. In the present embodiment the method to produce four small size thin film solar battery panels by cutting a large size thin film solar battery panel that has a thin-film layer formed on the glass-substrate into four small size panels is explained, wherein the respective small panels have thin-film layers removed from their peripheral parts on four sides of the plate-like members. The apparatus for treating a plate-like member is not limited to the ones that have the structure and components that are explained in the present embodiments. The structure and components can be modified depending on the needs.

Also, unless otherwise specified all the directions (left or right; up or down) referred to in the explanation are those based on the drawings.

The apparatus for treating a plate-like member (01) of the present invention comprises a treating unit (60), a transportation unit (50) that transports the work (W), and a housing (70) that covers the treating unit (60) and the transportation unit (50). The treating unit (60) comprises a chamber to treat the peripheral part (10) that treats the peripheral part of the work (W), a chamber to treat the inner part (30) that treats the inner part of the work (W), and, as necessary, a cleaning chamber to treat the peripheral part (62) (hereafter, "cleaning chamber E") that adjoins the chamber to treat the peripheral part (10) and a cleaning chamber to treat the inner part (67) (hereafter, "cleaning chamber I") that adjoins the chamber to treat the inner part (30).

(Chamber to Treat the Peripheral Part)

Figure 1:
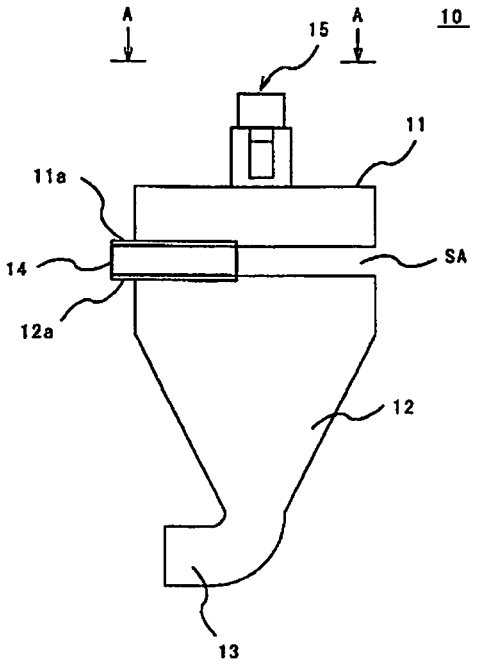
FIG. 1 is an illustration in one embodiment of the chamber to treat the peripheral part.
Figure 1:
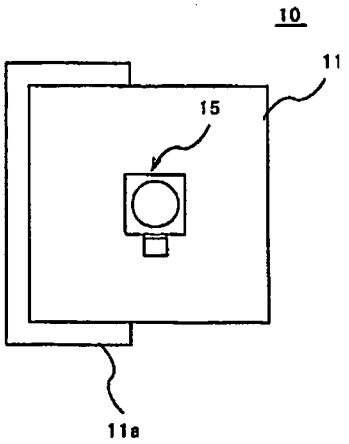
Figure 1:
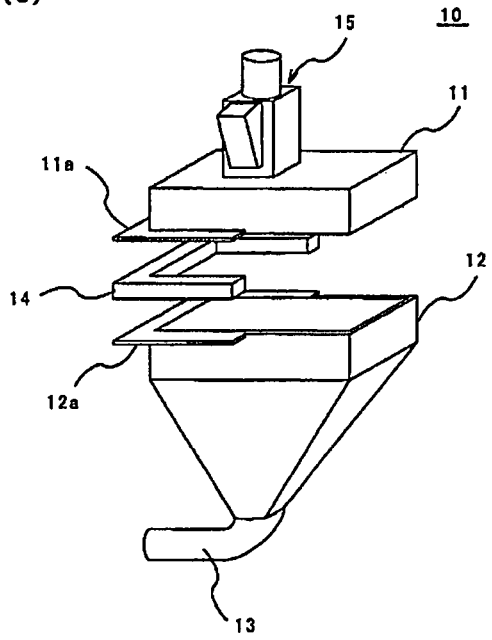

The structure and components of the chamber to treat the peripheral part (10) are explained based on the drawings. The chamber to treat the peripheral part (10) comprises a cover to prevent the scattering of the sprayed particles and the dust (11) (to treat the peripheral part) (hereafter, "cover to prevent the scattering of the sprayed particles and the dust A"), the cover having a cross section of a constant quadrangle and having a hollow center and a closed ceiling; a suctioning cover (12) (to treat the peripheral part) (hereafter, "suctioning cover A") that has the same cross section at the part that is closest to the cover to prevent the scattering of the sprayed particles and the dust A, its cross section continuing to decrease as it goes downward (toward the bottom) (an inverse square pyramid) and having a hollow center with both end-sides being open; a connecting member (14) (hereafter, "connecting member A") that connects the cover to prevent the scattering of the sprayed particles and the dust A with the suctioning cover A; a blasting nozzle for spraying particles (15) (to treat the peripheral part) (hereafter, "nozzle A") for a blasting treatment; and a suctioning member (13) (hereafter, "suctioning member A") (to treat the peripheral part) that connects a suctioning means with the cover to prevent the scattering of the sprayed particles and the dust A (see FIG. 1).

Flanges (11*a*) (12*a*) having the same shape (a U-type shape in the present embodiment) are provided at the positions where the cover to prevent the scattering of the sprayed particles and the dust A (11) and the suctioning cover A (12) are to be connected, respectively.

Figure 2:
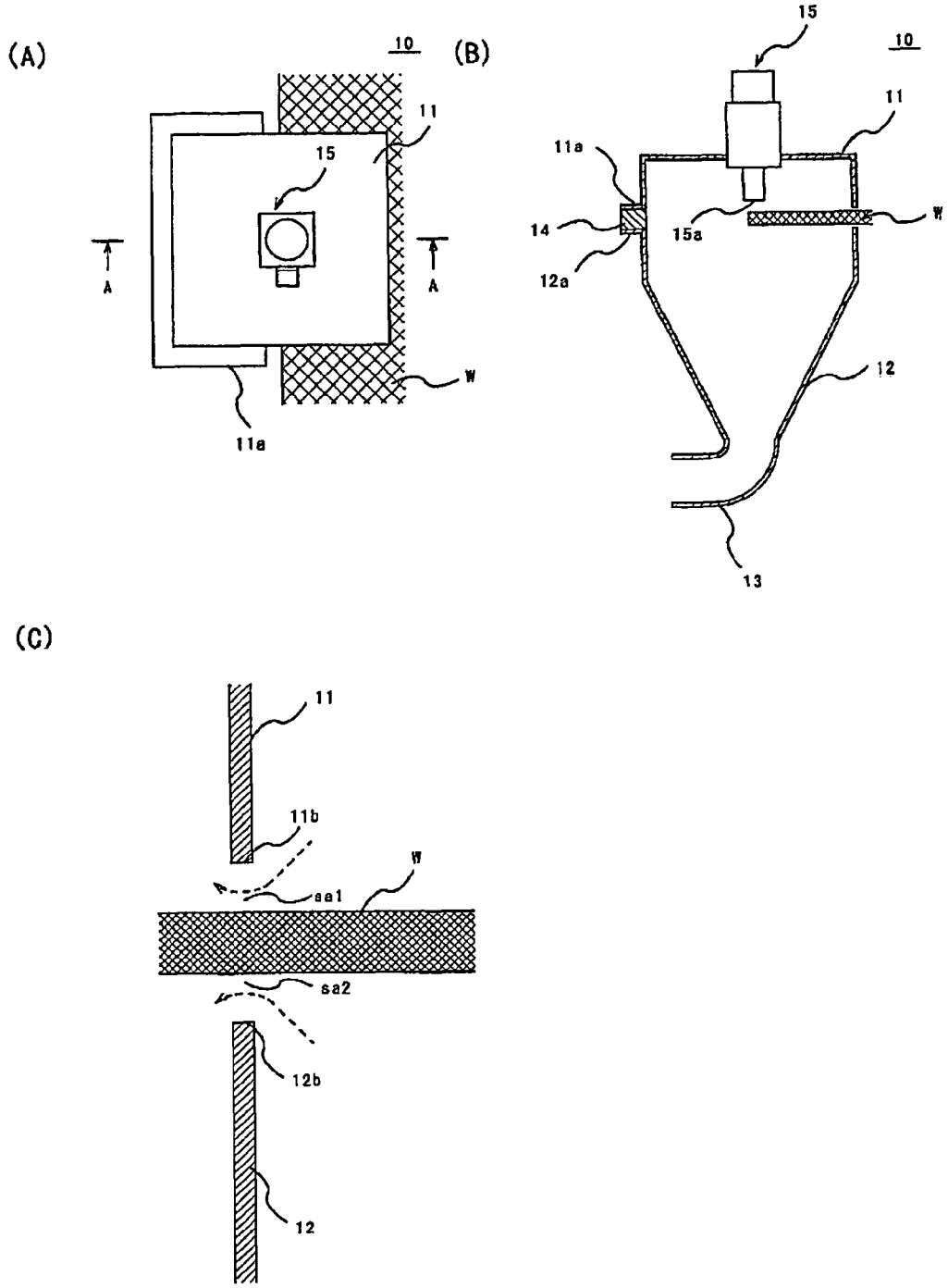
FIG. 2 is an illustration in one embodiment of the chamber to treat the peripheral part.

The flanges (11*a*) (12*a*), which both have the same shape, connect the cover to prevent the scattering of the sprayed particles and the dust A (11) to the suctioning cover A (12) by using the connecting member A (14) that has the same shape as the flange, whereby a continuous hollow space is formed by the cover to prevent the scattering of the sprayed particles and the dust A (11), the connecting member A (14), and the suctioning cover A (12), while a gap (SA) is formed within a part of the space produced between the cover to prevent the scattering of the sprayed particles and the dust A (11) and the suctioning cover A (12). The gap (SA) thus produced must have a shape where the peripheral part (the side to be treated) of the solar battery panel can be inserted and also where the gap must have a space that allows the peripheral part to pass through the gap. Also, when the work (W) is inserted into the gap (SA), the gaps (sa 1) (sa 2) that are formed between the open end sections (11*b*) (12*b*) of the cover to prevent the scattering of the sprayed particles and the dust A (11) and the work (W), and between the suctioning cover A (12) and work (W), respectively, must have a sufficient width (see FIGS. 1 and 2. A dashed line in FIG. 2 (C) shows how the outside air is introduced). The work (W) that has its side on the peripheral part that is inserted as shown in FIG. 2 (A), which side is the side to be treated, is treated as the work (W) is moved relative to the nozzle A in the upward and downward directions in FIG. 2 (A).

The suctioning cover A (12) has a suctioning member A (13) installed at the bottom. The suctioning member A (13) has a shape having a hollow center with its both end-sides open, one end-side being connected to the open end of the suctioning cover A (12) at the bottom of the suctioning cover A, the other end-side being connected to the suctioning means (a dust collector in the present embodiment) (not shown) through a duct (to treat the peripheral part). Thus, the cover to prevent the scattering of the sprayed particles and the dust A (11), the suctioning cover A (12), and the suctioning means each forms respective spaces that communicate with each other.

Figure 3:
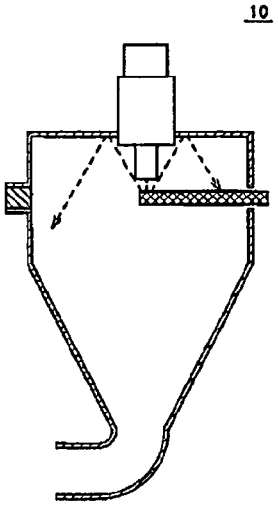
FIG. 3 is an illustration in one embodiment of the arrangement of the blasting nozzle for spraying particles for treating the peripheral part.
Figure 3:
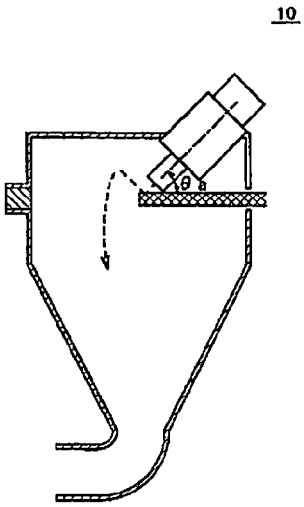

On the part that forms a ceiling of the cover to prevent the scattering of the sprayed particles and the dust A (11) is disposed a nozzle A. That is, the mouth (15*a*) of the nozzle A (15) is covered by the cover to prevent the scattering of the sprayed particles and the dust A (11). The nozzle A (15) can be placed vertically against the work (W). But preferably it is inclined at an angle of 30-75 degrees against the work (W) so that the mouth (15*a*) of the nozzle A (15) faces toward the peripheral part of the work (W). The particles that are sprayed from the mouth (15*a*) of the nozzle A against the work (W) and then collide with the work (W), and also the dust, such as the thin-film layer that is removed by the sprayed particles (hereafter, collectively "dust"), rise in the air. On the side below the work (W), that is, on the side of the suctioning cover A (12), the sprayed particles and the dust move toward the suctioning cover A (12), because the suctioning means that is connected to the suctioning member (13) suctions the outside air that is introduced through the gaps (sa1) (sa2). Then they are recovered by the suctioning means through the suctioning member A (13). Particularly, the sprayed particles tend to again collide with the work (W) after they bounce back upon colliding with the inner surface of the ceiling of the cover to prevent the scattering of the sprayed particles and the dust (11) or its side walls. But if the nozzle A (15) is inclined toward the peripheral part of the work (W), then the air that flows downward toward the suctioning member A (13) is generated, whereby the particles sprayed will not be directed toward the ceiling of the cover to prevent the scattering of the sprayed particles and the dust A or toward its side walls. So, the work (W) will not be damaged by the particles that bounce back after they collide with the ceiling of the cover to prevent the scattering of the sprayed particles and the dust (11) or its side walls (FIG. 3). If the angle theta a formed by the nozzle (15) and the Work (W) is too small, the force to remove (abrade) the thin-film layer cannot be obtained. If the angle theta a formed is too large, a sufficient effect to accelerate the flow of the sprayed particles and the dust toward the suctioning member A (13) cannot be obtained. In the present embodiment, the mouth (15*a*) of the nozzle A (15) has a rectangular shape $$(\text{width}(X_w) \geq \text{length}(X_L))$$

and the direction of the mouth (15*a*) of the nozzle (15) along its long side forms right angles to the side of the work (W) that is treated (see FIG. 13).

The nozzle A (15) comprises a body (15*c*); an air nozzle (15*b*) that introduces compressed air into the body (15*c*) of the blasting nozzle for a blasting treatment and that generates negative pressure; and a spraying section (15*d*) that has the mouth (15*a*) of the nozzle (15) for spraying the particles that are suctioned into the body of the nozzle by negative pressure and that are mixed with the compressed air in the mixing chamber of the body of the nozzle for blasting treatment.

The negative pressure is produced by the compressed air being suctioned from a source of the compressed air (not shown) into the inside of the body (15*c*) from the air nozzle (15*b*) through a hose for introducing pressured air (to treat the peripheral part) (not shown).

The particles for spraying are suctioned from a hopper for storing the particles for spraying (not shown) through a hose for supplying the particles for spraying (not shown) into the body (15*c*) of the nozzle by the negative pressure that is generated within the body (15*c*) of the nozzle.

The particles for spraying that are suctioned are mixed with the compressed air in the mixing chamber (15*e*) of the body (15*c*) of the nozzle and then sprayed from the mouth (15*a*) of the nozzle in a solid-gas two-phase flow.

The nozzle A (15) of this structure in the present embodiment can treat the work (W) for a long time in stable conditions (see FIG. 12).

If the thin-film layer has a higher hardness such that a stronger treating force is required to treat it, the particles for spraying can be sprayed in a solid-gas two-phase flow of the compressed air and particles for spraying, after the particles for spraying are thrown into the stream of the compressed air by increasing the pressure of the pressurized tank that contain the particles for spraying. In this case a pressurized tank and auxiliary equipment are required. So, equipment larger than that used in the present embodiment will be required. However, the speed of the particles that are sprayed will be greater and a powerful treating force will be obtained.

The outside air is introduced through the gaps (sa1) (sa2) into the chamber to treat the peripheral part at the open end sections (11*b*) (12*b*) of the cover to prevent the scattering of the sprayed particles and the dust A (11) and the suctioning cover A (12) as shown by the dashed line in FIG. 2 (C). To more efficiently introduce the outside air, guide members for introducing the outside air (11*c*) (12*c*) may be disposed at the open end sections (11*b*) (12*b*), respectively. The loss of pressure is reduced if the guide members are disposed and the outside air can be introduced efficiently. In the present embodiment, the guide member has a shape of an R as it goes from the inner side to the outer side. (See FIG. 4. In FIG. 4 the dashed line shows how the outside air is introduced.)

(Chamber to Treat the Inner Part)

The chamber to treat the inner part that is installed between the sides that are to be treated and that are parallel to each other is explained based on the drawings. The chamber to treat the inner part (30) comprises a suctioning cover (to treat the inner part) (hereafter, "suctioning cover B") (32) that has a continuous cross section of a square, and a hollow center with a closed ceiling; a suctioning member (to treat the inner part) (hereafter, "suctioning member B") (33) that connects the suctioning cover B and the suctioning member; and a blasting nozzle for treating the inner part (hereafter, "nozzle B") (35) that separates the sprayed particles and the dust that adhere to the work (W) by blowing the compressed air on the work (W). The suctioning member B (33) has a hollow center, with both its end-sides being open and one of the open end-sides being connected to the ceiling of the suctioning cover B (32) and the other end-side being connected to the suctioning means through a duct (to treat the inner part) (not shown). Namely, the suctioning cover B (32) and the suctioning means form spaces, respectively, that communicate with each other (see FIG. 5).

The suctioning cover B (32) is disposed above the work (W) and a sufficient gap (sb2) must be secured between the work (W) and the open end section (32*b*) of the suctioning cover B (32), so that the outside air can be introduced by the suctioning of the suctioning means (see FIG. 5 (D). The dashed line in FIG. 5 (D) shows how the outside air is introduced). As described, the work (W) is treated while it moves relative to the nozzle B (35).

The nozzle B (35) is disposed on the ceiling of the suctioning cover B (32). Namely, the mouth (35*a*) of the nozzle B (35) is covered with a suctioning cover B (32). The position of the suctioning member B (33) relative to that of the nozzle B (35) is preferably arranged in such a way that the suctioning member B (33) is disposed ahead of the nozzle B (35) in the direction of the movement of the work (W) (direction of the arrow in FIG. 5 (C)) and the nozzle B (35) is disposed at the rear of the suctioning member B (33) in the direction of the movement of the work (W). The angle (theta b) of the nozzle B (35) against the work (W) can be a right angle. But the nozzle B (35) preferably is disposed in such a way that the mouth (35*a*) of the nozzle B (35) faces in the direction of the movement of the work (W), that is, toward the position where the suctioning member B (33) is disposed and the nozzle B (35) preferably forms an angle of 30-75 degrees against the work (W). In the chamber to treat the inner part (30), the thin-film layer is abraded by the particles that were sprayed from the nozzle B (35) toward the work (W), and that collide with the work (W). The sprayed particles and the particles and dust that collided with the work (W) that were removed rise in the air. In the space above the work (W), where the suctioning means that is connected with the suctioning member B (33) suctions the outside air through the gap (sb2), the sprayed particles and the dust are recovered by the suctioning means through the suctioning member B (33). By disposing the mouth (35*a*) of the nozzle B (35) in an inclined position, so that the mouth faces in the direction of the movement of the work (W), the sprayed particles bounce back toward the suctioning member B (33) after they collide with the work (W). So, the sprayed particles are efficiently recovered. If the angle theta b is too small, the force to suction the outside air at the open end section (32*b*) is lower than the force of the sprayed particles. So, the sprayed particles will leak out of the chamber to treat the peripheral part. If the angle theta b is too large, the effects as described above will not be obtained. Moreover, the sprayed particles that collide with the wall and then bounce back may damage the work (W) (see FIGS. 6 (A) and (B)). So as to dispose the nozzle B (35) in an inclined position, the suctioning cover B (32) can be a trapezoid in its cross section, such that the suctioning member B (33) can be placed on one side of the slopes and the nozzle B (35) can be placed on the side other than the one where the suctioning member B (33) is disposed. (See FIG. 6 (C).)

Further, an auxiliary suctioning member (36) that has a hollow center and that has both its ends open, one end being connected to the suctioning means through a duct (to treat the peripheral part [for auxiliary suctioning]) (not shown) and the other end disposed on the side of the wall of the suctioning cover B (32), on which side is disposed the suctioning member B (33). The auxiliary suctioning member (36) is provided to accelerate the flow of the sprayed particles and the dust toward the suctioning member B (33) within the chamber to treat the inner part (30). So, the suctioning force of the auxiliary suctioning member (36) can be smaller than that of the suctioning member B (33). In the present embodiment five pieces of auxiliary suctioning members (36) that each have a diameter that is sufficiently smaller than that of the suctioning member B (33) are installed (See FIG. 7).

The shape or the structure of the nozzle B (35) is not limited, if it can remove the thin-film layer of the work (W) by blasting treatment. In the present embodiment, the nozzle that is the same as the nozzle A (15) was used. Also, the nozzle B (35) is laid in such a position that the long side of the mouth (35*a*) of the nozzle B (35) is perpendicular to the sides to be treated of the work (W) (See FIG. 13 (B)).

A guide member (32*c*) can be disposed at the open end section (32*b*) of the suctioning cover B (32) so as to efficiently suction the outside air. In the present embodiment the guide member (32*c*) has a shape of the letter R as it goes from the inner side to the outer (see FIG. 8. In FIG. 8 (C) the dashed line shows how the outside air is introduced), i.e., the same shape as the guide member for the chamber to treat the peripheral part (10).

(Cleaning Chamber)

If the work (W) has the sprayed particles and the dust attached (remains), after it is treated in the chamber to treat the peripheral part (10) and the chamber to treat the inner part (30), cleaning chambers (20) can each be installed next to the chamber to treat the peripheral part (10) and/or the chamber to treat the inner part (30), as necessary. The cleaning chamber comprises a suctioning cover (for cleaning) (hereafter, "suctioning cover C") (22) that has a hollow center, the upper part being closed by the ceiling and having a continuous cross section as that of a square; a suctioning member (for cleaning) (hereafter, "suctioning member C") (23) that connects the suctioning cover C to the suctioning means; and an air-blow nozzle (hereafter, "nozzle C" (25)) that blows compressed air against the work (W) and separates the sprayed particles and the dust from the work (W).

The suctioning member C has a hollow center and has both its end-sides open, one of the end-sides being connected to the ceiling of the suctioning cover C (22) and the other end-side being connected to the suctioning means through a duct (for cleaning) (not shown). That is, the suctioning cover C (22) and the suctioning means form spaces that communicate with each other. The cleaning chamber E (62), placed next to the chamber to treat the peripheral part (10), and the cleaning chamber I (67), placed next to the chamber to treat the inner part (30), can have the same or different shapes. In the present embodiment, the cleaning chamber E (62) and the cleaning chamber I (67) both have the same shape.

The nozzle C (25) is disposed on the ceiling of the suctioning cover C (22). That is, the mouth (not shown) of the nozzle (25) is covered by the suctioning cover C (22). The position of nozzle C (25) relative to that of the suctioning member C (23) and the angle of the nozzle, etc., can be changed depending on the conditions of the operation. For example, the suctioning member C (23) can be disposed on the ceiling of the suctioning cover C (22) ahead of the nozzle B (25) in the direction of the movement of the work (W) and the nozzle C (25) can be disposed at the rear of the suctioning member C (23) in the direction of the movement of the work (W). In the present embodiment, the nozzle C (25) is disposed at the center of the ceiling of the suctioning cover C (22) and a suctioning member C (23) is disposed on each side of the nozzle C (25), i.e., the forward and backward sides in the direction of the movement of the work (W) (see FIG. 9) and sandwiching the nozzle C (25) in-between.

The suctioning cover C (22) is disposed above the work (W). A sufficient gap (sb2) must be secured between the open end section (22*b*) of the suctioning cover C (22) and the work (W). Compressed air produced by the source of it is introduced through a hose (for cleaning the peripheral part) (not shown) that is connected to the source of the compressed air and to the nozzle C (25), into the nozzle C (25). Then the compressed air blown from the nozzle separates the sprayed particles and the dust from the work (W). The sprayed particles and the dust separated from the work (W) are suctioned by the suctioning means via the suctioning member C (23) and recovered while the outside air is being introduced through the gap (sc1) (see FIG. 9. In FIG. 9 (D), the dashed line shows how the outside air is introduced). A guide member (22*c*) can be disposed at the open end section (22*b*) of the suctioning cover C (22) so as to efficiently suction the outside air. In the present embodiment the guide member (22*c*) has a shape of the letter R as it goes from its inner side to the outer side, the same as for the chamber to treat the peripheral part (10) and the chamber (30) to treat the inner part (see FIG. 10. In FIG. 10 (C) the dashed line shows how the outside air is introduced).

If the sprayed particles and the dust strongly adhere to the work (W), the materials (some water, electrostatic discharging agent, ions, radicals, etc.) that can weaken the adhesion, for example, by discharging the electricity, can be sprayed with the compressed air. Supersonic air-blowing can be used. Also, the shape of the mouth of the spray nozzle is not limited to a square, circle, etc. It can be selected from the other shapes depending on the requirements.

(Treating Unit)

A treating unit (60) comprises a unit to treat the peripheral part (61) consisting of a pair of chambers to treat the peripheral part (10) that treat the two sides of the work (W) that are parallel to each other and cleaning chambers E (62), each of which adjoins the chamber to treat the peripheral part (10) and are connected to the chamber to treat the peripheral part (10) by a connecting member (to treat the peripheral part) (hereafter, "connecting member E"); and a unit to treat the inner part (66) consisting of a chamber to treat the inner part (30) disposed between the chambers to treat the peripheral part (10) and a cleaning chamber I (67) that adjoins the chamber to treat the inner part (30) and that is connected to the chamber to treat the inner part (30) by a connecting member (to treat the inner part) (hereafter, "connecting member I") (66*c*).

Two or more units to treat the inner part (66) or none can be installed, based on the need. As described above, the work (W) is moved relative to the nozzle A (15) and the nozzle B (35). So, the cleaning chamber E (62) can be placed ahead of the nozzle (A) and nozzle (B) and on the side walls of the chamber to treat the peripheral part (10), as seen from the direction of the relative movement of the work (W). Or it can be placed both ahead of and at the rear of the chamber to treat the peripheral part (10). Also, the cleaning chamber I (67) can be placed ahead of the nozzle (A) and nozzle (B) and on the side walls of the chamber to treat the inner part (30), as seen from the direction of the relative movement of the work (W) Or it can be placed both ahead of and at the rear of the chamber to treat the inner part (30). As necessary, the cleaning chamber E (62) and the cleaning chamber I (67) need not be installed. In the present embodiment, as shown in FIG. 11, one chamber to treat the inner part (30) is installed and the cleaning chamber E (62) and the cleaning chamber I (67) are each disposed ahead (in the direction of the arrow in FIG. 11) of the chamber to treat the peripheral part (10) and the chamber to treat the inner part (30), respectively, as seen from the direction of the relative movement of the work (W).

A pair of the chambers to treat the peripheral part (10) are preferably disposed in such a way that the imaginary line (i) that connects the centers of the mouths (15*a*) of the pair of the nozzles A (15) is parallel to the sides other than those sides on the peripheral parts that are to be treated (the shaded area in FIG. 13 (A)). This is because if so disposed, the peripheral parts will be treated in the shortest time. However, the pair of the chambers to treat the peripheral part (10) can be installed in either of the following ways, namely, such an imaginary line is parallel to the sides of the peripheral parts that are not to be treated or it is inclined against the sides of the peripheral parts that are not to be treated, depending on the size of the work (W) or the shape of the apparatus (01). Also, the chamber to treat the inner part (30) may only be installed between the sides of the peripheral parts that are to be treated. The center of the mouth (35*a*) of the nozzle B (35) need not be on the imaginary line (i) (see FIG. 13 (B)).

(Transportation Unit)

A transportation unit consists of a means to carry in the work (W) (51A) to the transfer means (52), a means to carry out the work (W) (51B), of which the treatment has been completed, outside the housing (70) and the transfer means (52) that moves the work (W) that is to be treated by the treating unit (60). A means to carry out the work (W) (51B) that carries out the work (W), of which the treatment has been completed, outside the housing (71) can also work as a means to carry in the work (W) (51A) that carries the work (W) to the transfer means (52). In the present embodiment the means to carry in the work (W) (51A) and the means to carry out the work (W) (51B) are installed separately in a transportation means (51).

The means to carry in the work (W) (51A) comprises rollers for transport (51*a*) that carry the work (W) on top of them; a shaft (51*b*) that completely pierces the center of the axis of the roller and supports the roller for transport (51*a*); and a driving means (not shown) that is connected to the shafts and that drives the rollers for transport (51*a*). Also, each roller for transport (51*a*) is laid out in such a way that it forms a zigzag formation in relation to its adjacent rollers. By this way even if any force that would make the work (W) move in a zigzag manner occurs during the transportation, a force that cancels such a movement would keep the work (W) moving in the right direction.

The work (W) placed on the means to carry in the work (W) (51A) contacts the rollers for transport (51*a*). The driving means (a motor in the present embodiment) is connected to the shaft through a means to transmit the driving force (a pulley and a belt in the present embodiment). The work (W) is transported by the rotations of the shaft (51*b*) and the rollers for transport (51*a*), which rotations are driven by the driving means. A means to determine the position to stop is installed so as to stop the work (W) that is transported to the predetermined position. The means to determine the position to stop comprises a means to determine the position in the direction of the transport (hereafter, "transporting direction") of the work (W), which means is disposed so as to control the position in the transporting direction of the work (W) (right hand side in FIG. 14 (B)) and means to determine the positions on the side to be treated, which means are disposed on the upper and lower sides in FIG. 14 (B), respectively. In the present embodiment, the means to determine the position in the transporting direction of the work (W) comprises two members to do so (hereafter, "member to determine the position A") (53*a*). Each has a shape of a pillar and is disposed in such a way that the imaginary line (ia) connecting the axis of each member to determine the position A lies perpendicularly to the transporting direction (the right direction in FIG. 14 (B)). The work (W) that is transported contacts the members to determine the position A (53*a*) on their circular-arch surfaces, and then stops, such that the position in the transporting direction where the work (W) stops is determined depending on the position of the members to determine the position A (53*a*). Also, the means to determine the positions on the side to be treated comprises at least one member to determine the position on the side to be treated (hereafter, "member to determine the position B") (53*b*) on each of the upper and lower sides of the work (W), as seen in FIG. 14 (B), each member having a shape of a cylinder. The members to determine the position B (53*b*) are each connected to a driving means (not shown), which move the member to determine the position B (53*b*) in the direction perpendicular to the transporting direction of the work (W), whereby the side of the work (W) contacts the circular-arch surface of the members to determine the position B (53*b*), and then the work (W) is moved. Then the position of the work (W) in the upward and downward directions is determined.

If roller are used for the members to determine the position A (53*a*) and the members to determine the position B (53*b*), the wear on the part in the member to determine the position A (53*a*) and on the member to determine the position (53*b*) because of their contact with the work (W) will be reduced. That is because the parts of the members to determine the position A (53*a*) and the parts of the members to determine the position (53*b*) where the work (W) contacts vary in each operation. In the present embodiment the members to determine the position A (53*a*) are provided in two numbers for transporting direction side of the work (W), and the member to determine the position B (53*b*) is provided each for each upper and lower side of the work (W). However, the number can be changed depending on the need (for example, the number of the members to determine the position B (53*b*) can be two on each upper and lower side of the work (W) and each set of the members can be disposed in such a way that imaginary lines connecting the axis of the two members to determine position lie parallel to the upper and the lower sides of the peripheral parts to be treated of the work (W), respectively.

Also, no means to determine the position to stop can be provided or the means to determine the position on the side to be treated can be provided only on one side. Also, the means to determine a position in the direction of the transport of the plate-like member can comprise the members to determine the position in the transport direction of the work (W) (53*a*) combined with other member. The means to determine the positions on the side to be treated can comprise the members to determine the position on the side to be treated of the work (W) (53*b*) combined with other member.

In the present embodiment, the means to carry out the work (W) (51B) has the same structure as the means to carry in the work (W) (51A), except that it does not have a means to determine the position to stop.

The work (W) may be damaged on the part of the surface of the work (W), which part contacts the roller for transport (51*a*), depending on the kinds of materials of the rollers for transport (51*a*), when the work (W) is transported by the means to carry in the work (W) (51A) and the means to carry out the work (W) (51B). For example, if the dust floating in the air settles on the rollers for transport (51*a*), that will damage the work (W). Also, if the sprayed particles and the dust remain on the work (W) that has its treatment completed, these sprayed particles and the dust will be caught up in the rollers for transport (51*a*) and will damage the work (W). So as to prevent the work (W) from being damaged, the material of the rollers for transport (51*a*) is preferably foamed urethane having a structure that includes separated air bubbles, which works as a cushion and prevents the work (W) from being damaged even if any hard materials such as the sprayed particles and the dust are involved during the transport by the rollers.

As described above, the work (W) can be continuously treated by having the work (W) moved relatively to the nozzle A (15) and the nozzle B (35).

The term "move(d) relatively" or "relative movement" in the embodiments refers to either where only the work (W) itself is moved and the treating unit is not moved or where the treating unit is moved while the work (W) is not moved. So, when the work (W) is said to move "relatively," it includes the case where the chamber to treat the peripheral part (10), the unit for treating the peripheral part (20), the chamber to treat the inner part (30), and the unit to treat the inner part (66), are moved, while the work (W) is not moved. But in the process of the treatment, preferably the work (W) is moved, because if the work (W) is moved, the treatment is more easily carried out. Also, the structure of the apparatus becomes simpler. In the present embodiment the work (W), rather than the transfer means (52), was moved.

The transfer means (52) of the present invention comprises a table (52*a*) that carries the work (W), a positioning device that determines the position of the work (W) in the direction of the height (hereafter, "positioning device" (52*b*)), a turning device (52*c*) that turns the work (W) by 90 degrees around the center of its horizontal surface, and a means to move (52*d*) that moves the transfer means (52) itself. The table (52*a*) has a fixing device (not shown) that fixes the work (W) that it carries on it to the table (52*a*).

(Apparatus for Treating a Plate-Like Member)

As shown in FIG. 14, the apparatus for treating a plate-like member (01) comprises the treating unit (60), the transportation unit (50), and the housing (70). To simplify the explanation the ducts or the hoses are omitted from the drawings. The unit to treat the peripheral part (61) is connected to a device to adjust the position (65) by means of an arm (to treat the peripheral part) (hereafter, "arm E") (61*a*) connected to the connecting member E (61*c*). By the device to adjust the position (65), the unit to treat the peripheral part (61) can adjust its position by moving in the left and right direction in FIG. 14 (C), corresponding to the size and the movement of the work (W). Also, the unit to treat the inner part (62) is connected to the device to adjust the position (65) through the connecting member (I) (66*c*).

In FIG. 14 (B) the work (W) moves from left to right. The transportation unit (50) comprises, from left to right in FIG. 14, the transportation means (51A) (means to carry in the plate-like member), transfer means (52), and transportation means B (51B) (means to carry out the plate-like member). They are arranged in a way that the centers of each of them are on a straight line. Also, the treating unit (60) is placed so that (1) the center of the imaginary line (i) formed by connecting both the mouths of the nozzles A (15), as shown in FIG. 13 (C), and (2) the mouth of the nozzle (35*a*) of the blasting nozzle B are located on the line that is formed by connecting the centers of the transportation means A (51A), transfer means (52), and transportation means B (51B).

The housing (70) covers the treating unit (60), the entire transfer means (52), and the means to carry in the work (W) A (51A), and the means to carry out the work (W) B (51B). Also, it has an opening (71*a*) for carrying in the work (W) into the housing (70) and an opening (not shown) for carrying out the work (W) out of the housing (70).

(Method of Treatment)

A method to remove the thin-film layer from the solar battery panel using the apparatus for treating a plate-like member (01) is explained, based on FIG. 15. The shaded areas in FIG. 15 shows the parts where the thin-film layer were removed from the solar battery panel using the apparatus.

First the treating conditions (size of the work (W), speed of the transport of the work (W), the pressure of the particles sprayed, the patterns of the treatment (width to be treated, whether the inner part is treated, etc.) etc.), are entered into the control device (not shown). The distance between the unit to treat the peripheral part is determined with the device to adjust the position (65) based on data about the size of the work (W) entered, so that the two parallel sides of the work (W) pass the openings (SA) of the chambers to treat the peripheral part (10). The work (W) is placed on the means to carry in the work (W) (51A) and is carried into the housing (70) through the opening (70*a*) of the housing (70). The work (W) that is carried into the housing stops when the side that is perpendicular to the sides to be treated (the upper and lower sides in FIG. 14 (B)) contacts the circular-arch surfaces of the members to determine the position A (53*a*). Then the members to determine the position B (53*b*) that are connected to the driving means each move toward the sides to be treated and move the work (W) to the predetermined position in the upper and the lower directions of FIG. 14 (B), whereby the work (W) is transported onto the transfer means (52) by the means to carry in the work (W) (51A) (this position is hereafter called "the position for starting the treatment"). The work (W) transported onto the transfer means (52) is fixed onto the transfer means (52) by the fixing means (for example, a suctioning device or a pad that has a high friction coefficient) disposed on the table (52*a*). Then, the work (W) is moved upward by the positioning device (52*b*) so that it ceases to contact the transportation means (51A). At the same time the position of the work (W) in the direction of the height (the upper and the lower directions of FIG. 14 (D)) is adjusted by the positioning device (52*b*) so that not only the opening (SA) has a sufficient width to allow the work (W) to pass through, but also there are sufficient gaps between the work (W) and the unit to treat the peripheral part (61) and also between the work (W) and the unit to treat the inner part (66).

The particles are sprayed from the mouths (15*a*) (35*a*) of the nozzle A (15) and nozzle B (35), respectively. The suctioning means that are connected respectively with the chamber to treat the peripheral part (10), chamber to treat the inner part (30), cleaning chamber A (62), and cleaning chamber B (67) are operated at the same time (the number of suctioning means to be disposed is optional). Then the transfer means (52) moves the work (W) in a direction from left to right in FIGS. 14 (B) and 15 (A) whereby the work (W) passes right below the nozzle A (15) and nozzle B (35). Thus the particles sprayed from the nozzle A (15) and nozzle B (35) collide with the work (W), thereby the thin-film layer is abraded and removed. The sprayed particles and the dust are suctioned and recovered by the suctioning means through the suctioning member A (13) and suctioning member B (33). The treatments of the two sides on the peripheral parts of the work (W) and its inner part are complete when the work (W) that is inserted into the chambers to treat the peripheral part (10) passes through the unit to treat the peripheral part (20) and the unit to treat the inner part (40) (hereafter this position is called the "position of completion of the treatment") (see FIGS. 15 (A) and 15 (B)).

The units to treat the peripheral part (20) are moved by the device to adjust the position (65) in the direction that the distance between the units becomes wider. This distance must be sufficiently wider than the length of the diagonal line of the work (W). Then, the work (W) is turned by 90 degrees by the turning device (52*c*) and at the same time the work (W) is moved to the position for starting the treatment. After the work (W) is transported to the position, the distance between the units to treat the peripheral part (20) is determined by the device to adjust the position (65), based on the conditions of the treatment that were entered (see FIG. 15 (C). Then the work (W) is moved by the transfer means (52) to the position for the completion of the treatment in the direction from the left to the right of the drawing. The treatment of the other two sides on the peripheral parts and the inner part are complete (see FIG. 15 (D)).

The work (W) which has its treatment completed is placed on the means to carry out the work (W) (51B) by the positioning device (52*b*) that is lowered. Then the work (W) is shipped out (carried out) of the housing (70) by the means to carry out the work (W) (51B) through the opening of the housing (70). The work (W) that is manufactured is cut by a known method and a plurality of works (Wc) (four pieces in FIG. 15), of which the peripheral parts are treated, are obtained (see FIG. 15(E)). The thin-film layer on the peripheral parts of the work (Wc) were removed and the substrate is exposed.

(Alternative Example)

If the sprayed particles and the dust can sufficiently be suctioned by the suctioning means that are connected to the chamber to treat the peripheral part (10) and the chamber to treat the inner part (30), neither the cleaning chamber A (62) nor the cleaning chamber B (67) need be provided. Namely, the work (W) can be treated only by the chamber to treat the peripheral part (10) and the chamber to treat the inner part (30). Also, either the cleaning chamber A (62) or the cleaning chamber B (67) can be used.

If only the peripheral part(s) of the work (W) is to be treated, the chamber to treat the inner part (30) need not be provided. Or even if the chamber to treat the inner part (30) is provided, then, the nozzle B (35) need not spray the particles.

More than one chamber to treat the inner part (30) can be provided. If more than one chamber to treat the inner part (30) is installed, the treatment as above described can be performed where the work (W) can be cut into the works of a smaller size. If two chambers to treat the inner part are installed, nine pieces of the works (w) can be obtained from the work (W).

The cleaning chamber (20) can have the suctioning member C (23) disposed ahead of the nozzle C (25) in the direction of the relative movement of the work (W) and the nozzle C (25) disposed at the rear of the suctioning member C (23) in the direction of the relative movement of the work (W). Then, the nozzle C (25) is preferably disposed in such way that its mouth faces forward in the direction of the movement of the work (W). The compressed air sprayed from the nozzle C (25) collides with the work (W) and bounces back. But since the nozzle C (25) is inclined, it moves toward the suctioning member C (23). Namely, the compressed air that bounced back contains the particles and the dust that were broken away from the work (W). Thus the cleaning chamber (20) efficiently suctions and recovers these particles and the dust. The angle between the nozzle C (25) and the work (W) preferably is set at an angle of 30-75 degrees. If the angle is too small, the force to suction the outside air at the open end section (22*b*) of the suctioning cover X (22) is lower than the force of the compressed air. So, the sprayed particles and the dust may leak out of the chamber to treat the peripheral part. If the angle is too large, the effects as described above are not obtained.

In the present embodiment, the work (W) can be treated if the particles are sprayed from the nozzle B (35) when the work (W) is in either of the following positions of the treatment, i.e., where the work (W) is not turned (by 90 degrees) (FIG. 15 (A)) or where the work (W) is turned by 90 degrees (FIG. 15 (D)). So, as in the present embodiment, if one set of the unit to treat the inner part (40) is used to treat the inner part of the work (W) having a square shape, two pieces of the works (w) of a rectangular shape can be obtained from one piece of the work (W). Also, depending on the size of the work (w) that is to be obtained, more than one chambers to treat the inner part or the units to treat the inner part can be installed.

After completing the treatment of the two parallel sides on the peripheral parts, the work (W) may be turned at the position of completion of the treatment. Then after the work (W) is transported back to the position for starting the treatment by the transfer means (52), the other two sides of the work (W) can be treated there. Namely, the work (W) can be treated because the transfer means (52) move the work (W) back and forth between the position of the completion of the treatment and the position for starting the treatment. But in this case, the work (W) is transported in another direction. So, if the cleaning chamber A (21) and the cleaning chamber B (41) are to be placed next to the chamber to treat the peripheral part (10) and the chamber to treat the inner part (30), respectively, they must be placed not only ahead of the chamber in the direction of the movement of the work (W) before it is turned, but also ahead of the chamber in the direction of the movement of the work (W) after it is turned, respectively. Also, in this case, the means to carry in the work (W) (51A) can play roles of both the means to carry in and to carry out the work (W).

The treating unit (60) can be moved after the work (W) is fixed to the table (52 *a*) and can treat the work (W).

The housing need not cover the treating unit (60), the entire transfer means (52), the entire means to carry in the work (W) (51A) or the entire means to carry out the work (W) (51B). It may cover only a part of them, such as those disposed between the position for starting the treatment and the position of completion of treatment. The housing may not be provided if the sprayed particles or the dust from the treating unit is not expected to leak out or if there is little chance that the dust in the environment will adhere to the work (W) or the rollers (51*b*).

In the present embodiment, two chambers to treat the peripheral parts are installed to simultaneously treat the two parallel sides of the work (W). But only one chamber to treat the peripheral part can be installed to treat the peripheral part.

EXAMPLES

The thin-film layer on the thin film solar battery panel having a size of 1,100×1,400 mm was removed from the peripheral parts on the four sides of the work (W) (the width of removal: 11 mm) using the apparatus for treating the work (W) of the present invention (the particles are not sprayed from the nozzle B (35), because only the thin-film layer on the peripheral part is to be removed). From the nozzle A, the particles (WA #600) were sprayed at the injection pressure of 0.6 MPa. The speed of the movement of the work (W) is set at 200 mm/sec (Example 1). To compare the results of the treatment, a similar experiment is carried out in a chamber for blasting treatment, of which the bottom communicates with the suctioning means, by moving a blasting nozzle for spraying particles wherein the blasting nozzle for spraying particles is connected to the means that moves a blasting nozzle for spraying particles. The blasting nozzle for spraying particles, the injection pressure, and the sprayed particles, are the same as those of Example 1. The speed of the movement of the blasting nozzle for spraying particles is the same as the speed of the movement of the thin film solar battery panel of Example 1, namely, 200 mm/sec (comparative example 1). The results are evaluated as to the time required for treatment, the remains of the thin-film layer in the area that was treated and the damages on the area outside the treated area. The evaluation of the results for the area that is treated is made by SEM, wherein the results are sorted out as follows: no remains of the thin-film layer observed—circle; the thin-film layer remains but is isolated—triangle (the thin-film layer remains but is not continuous from the thin-film layer in the area that is not treated); the thin-film layer remains and is continuous from thin-film layer in the area that is not treated—X. SEM was used to evaluate the damages on the thin-film layer in the area that is not treated, where the levels of the damages are sorted out as follows: no damage observed in the area 1 mm or more apart from the boundary of the treatment—double circle; no damage observed in the area 2 mm or more apart from the boundary of the treatment—circle; the damage observed in the area 2 min or more apart from the boundary of treatment—X (see FIG. 28. The arrow shows a damaged part [a portion]). In the treatment of the thin-film solar battery panel, if the area that is not treated were to be damaged, the electromotive force of the panel would be adversely affected. So, preferably the thin-film solar battery panel does not have damages in the area 1 mm or more from the boundary of the treatment. But the thin-film solar battery panel, if it does not have damage in the area 2 mm or more apart from the boundary of the treatment, can be used.

In Example 1, the work (W) that was treated for 40 seconds has no observed remains of the thin-film layer. The damages in the area that was not treated were not found in the part of the area 1 mm or more apart from the boundary of the treatment. In contrast, in comparative Example 1, the time required to treat the work (W) was 90 seconds, which is 2.25 times the time required to treat the work (W) in Example 1. Also, although no remains of the thin-film layer was observed, much damage in the area that was treated was found, even in the part of the area that is 2 mm or more apart from the boundary of the treatment. This is because the sprayed particles and the dust that bounced back from the surface of the work (W), after colliding with the blasting nozzle for spraying particles and the peripheral devices (for example, the means to move the nozzle), struck the area outside the area that was treated. In Example 1, apparently because the sprayed particles that collided with the surface of the work (W) are suctioned and recovered by the suctioning means through the suctioning member (13), the particles were prevented from damaging the area outside the area that was treated, as described above. Also, because of the gaps (sa1) (sa2) that introduce the outside air into the chamber to treat the peripheral part (10), no damage caused by the contact between the work (W) and the chamber to treat the peripheral part (10) is observed on the work (W).

Also, in the present embodiment, the treatment of the peripheral part and the inner part of the work (W) was carried out by the particles (WA#600) being sprayed from the nozzle B (35) under the same conditions as in Example 1 (Example 2).

The treatment of the peripheral part and the inner part of the work (W) was able to be carried out within the same time as in Example 1. No remains of the thin-film layer were observed in the area that was treated. Damages on the area that was not treated were not observed in the area 1 mm or more apart from the boundary of the treatment. So, the result of the evaluation was denoted "double circle." However, in the inner part, no damage was observed in the area 2 mm or more apart from the boundary, but damage was observed in the area 1-2 mm apart from the boundary, giving the result of the evaluation as "circle." This is apparently because the sprayed particles that bounced back from the surface of the work (W) were suctioned and recovered by the suctioning means through the suctioning member (33), and the particles were prevented from damaging the area, unlike for comparative Example 1, as described above. However, compared with the treatment of the peripheral part, in the treatment of the inner part the sprayed particles and the dust were not suctioned by the suctioning member (33) so smoothly, such that the results of the evaluations of the treatment for the peripheral part were better than those for the inner part. However, as discussed above, it will not cause any problem if they are put to use in a practical application. Also, because of the gap (sb2) that introduces the outside air into the chamber to treat the inner part (30) and that prevents the contact between the work (W) and the chamber to treat the inner part (30), no damage to the work (W) was observed.

TABLE 1

| | Time for treatment (s) | Remains of the thin-film layer in the treated area | Damage to the thin-film layer in the untreated area |
|---|---|---|---|
| Example 1 | 40 | ○ | ◎ |
| Example 2 | 40 | ○ | ○ |
| Comparative Example 1 | 90 | ○ | X |

Note:
○ = circle
◎ = double circle

INDUSTRIAL APPLICABILITY

In the embodiments, the treatment of the thin film solar battery panel is explained. However, the apparatus for treating a plate-like member of the present invention can be used not only to completely remove the thin-film layer from a substrate such as the thin film solar battery panel, but also it can be used to remove a part of a thin-film layer on the peripheral parts (for example, the thin-film layer produced in a wet process), where the thin-film layer is thicker than the one in the other part, so as to adjust the entire thickness of the thin-film layer.

A resist film is formed on the substrate to enable the etching. The resist film is removed by a chemical treatment after the etching process. But the resist film tends to remain on the peripheral part of the substrate. The apparatus of the present invention can remove the resist film that remains on the peripheral part of the substrate.

The basic Japanese Patent Application, No. 2010-128542, filed Jun. 4, 2010, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various possible changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not limit the scope of the invention unless otherwise noted

SYMBOLS

01 Apparatus for treating a plate-like member
10 chamber to treat the peripheral part
11 cover to prevent the scattering of the sprayed particles and the dust (for treating the peripheral part)
11*a* flange
11*b* open end section
11*c* guide member
12 suctioning cover (for treating the peripheral part)
12*a* flange
12*b* open end section
12*c* guide member
13 suctioning member (for treating the peripheral part)
14 connecting member
15 blasting nozzle for spraying particles (for treating the peripheral part)
15*a* mouth of the nozzle
15*b* air nozzle
15*c* body of the nozzle
15*d* spraying section
15*e* mixing chamber
20 cleaning chamber
22 suctioning cover (for cleaning)
22*b* open end section
22*c* guide member
23 suctioning member (for cleaning)
25 air-blowing nozzle
30 chamber to treat the inner part
32 suctioning cover (for treating the inner part)
32*b* open end section
32*c* guide member
33 suctioning cover (for treating the inner part)
35 blasting nozzle for spraying particles (for treating the inner part)
35*a* mouth of the nozzle
36 auxiliary suctioning member
51 transportation means
51A means to carry in the plate-like member
51B means to carry out the plate-like member
51*a* rollers for transport
51*b* shaft
52 transfer means
52*a* table
52*b* positioning means
52*c* turning device
53*a* member to determine the position in the transporting direction of the work (W)
53*b* members to determine the position on the side to be treated
60 treating unit
61 unit to treat the peripheral part
61*a* arm (for treating the peripheral part)
61*c* connecting member (for treating the peripheral part)
62 cleaning chamber to treat the peripheral part
65 device to adjust the position
66 unit to treat the inner part
66*a* arm (for treating the inner part)
66*c* connecting member (for treating the inner part)
67 cleaning chamber to treat the inner part
70 housing
70*a* opening
W work to be treated
Wc work obtained by cutting the large scale work (W)
SA, sa1, sa2, sb1, sb2 gap
i, ia, imaginary line

The invention claimed is:

1. An apparatus for removing an unnecessary thin-film layer on the periphery of a substrate of a plate-like member having a square shape, on the surface of which substrate is formed a thin-film layer, the apparatus for removing the unnecessary thin-film layer comprising:

a chamber to treat the peripheral part comprising an opening into which the peripheral part of the plate-like member is inserted and in which chamber the unnecessary thin-film layer on the peripheral part of the plate-like member is removed; and a means to move the plate-like member relative to a blasting nozzle for spraying particles that is disposed in the chamber to treat the peripheral part, wherein the chamber to treat the peripheral part comprises;

a cover having end sides to prevent the scattering of the sprayed panicles and the dust for treating the peripheral part, the cover having one of its end sides that forms a ceiling being closed and having another end-side, which is opposed to the ceiling, being open;

a blasting nozzle for spraying particles, which nozzle carries out the blasting treatment by spraying the particles on the surface of a workpiece, which is a plate-like member, the blasting nozzle for spraying particles for treating the peripheral part being disposed on the cover to prevent the scattering of the sprayed particles and the dust, so that the mouth of the blasting nozzle is covered by the wall of the cover to prevent the scattering of the dust;

a suctioning cover for treating the peripheral part, having an opening that has the same shape as the opening of the cover to prevent the scattering of the sprayed particles and the dust;

a suctioning member having end sides for treating the peripheral part, which member has a hollow center, having both end sides being kept open and the end sides each communicating with the suctioning cover for treating the peripheral part and a suctioning means;

wherein the cover to prevent the scattering of the sprayed particles and the dust for treating the peripheral part and the suctioning cover for treating the peripheral part form a structure where their openings communicate with each other, and where the opening is formed, into which opening the peripheral part of the plate-like member is inserted, wherein, when the peripheral part of the plate-like member is inserted, the opening in the structure is formed so as to form gaps between the uppermost open end section of the opening and the surface of the workpiece and between the lowest open end section of the opening and the reverse surface of the workpiece, through which gaps outside air can be introduced, wherein a continuous hollow space is formed by the cover to prevent the scattering of the sprayed particles and the dust, being connected to the suctioning cover;

wherein the cover to prevent the scattering of the sprayed particles and the dust, the suctioning cover, and the suctioning means that is connected to the suctioning member located at the bottom of the suctioning cover, each forms respective spaces that communicate with each other, and wherein the sprayed particles and the dust move toward the suctioning cover, because a suctioning means that is connected to the suctioning member suctions the outside aft that is introduced through the gaps.

2. The apparatus for treating a plate-like member of claim 1, wherein the blasting nozzle for spraying particles for treating the peripheral part and the plate-like member form an angle of 30 to 70 degrees when the plate-like member is inserted into the opening.

3. The apparatus for treating a plate-like member of claim 1 comprising a guide plate at least at one of the open end sections of the opening of the chamber to treat the peripheral part so as to have the outside air introduced through the openings.

4. The apparatus for treating a plate-like member of claim 1, comprising two chambers to treat the peripheral part wherein the chambers to treat the peripheral part are each disposed on the two parallel sides on peripheral parts of the plate-like member, which is placed flat.

5. The apparatus for treating a plate-like member of claim 4 comprising the chambers to treat the peripheral part that are disposed in such a way that the line connecting the two chambers is parallel to the two parallel sides of the plate-like member other than those parallel sides of the peripheral parts that are to be treated.

6. The apparatus for treating a plate-like member of claim 4 comprising at least one chamber to treat the inner part of the plate-like member that is disposed between the parallel sides on the peripheral parts of the plate-like member that are to be treated, the chamber to treat the inner part of the plate-like member treating the inner part in such a way that the treated inner part is parallel to the parallel peripheral sides of the plate-like member that are to be treated.

7. The apparatus for treating a plate-like member of claim 6, wherein the chamber to treat the inner part of the plate-like member comprises:

a hollow suctioning cover for treating the inner part, the suctioning cover having one end-side that forms a ceiling being closed and having the other end-side that opposes the ceiling being open;

a blasting nozzle for spraying particles for treating the inner part of the surface to be treated by spraying particles, the blasting nozzle for spraying particles being disposed on the suctioning cover for treating the inner part in such a way that the mouth of the nozzle is covered by the side walls of the suctioning cover for treating the inner part; and a suctioning member for treating the inner part, both end-sides of which member are open and communicate with the suctioning cover for treating the inner part and the suctioning means, respectively, wherein a gap can be provided between the open end section of the suctioning cover and the surface of the workpiece so that the outside air can be suctioned through it.

8. The apparatus for treating a plate-like member of claim 7, wherein the blasting nozzle for spraying particles for treating the inner part is disposed at the rear of the suctioning member for treating the inner part in the direction of movement of the plate-like member relative to the blasting nozzle for spraying particles; and the suctioning member for treating the inner part is disposed ahead of and above the blasting nozzle for spraying particles in the direction of the movement of the plate-like member relative to the blasting nozzle for spraying particles.

9. The apparatus for treating a plate-like member of claim 8, wherein the blasting nozzle for spraying particles for treating the inner part of the plate-like member is disposed in such a way that the angle between the blasting nozzle and the plate-like member is 30-75 degrees.

10. The apparatus for treating a plate-like member of claim 8, wherein an auxiliary suctioning member that communicates with the suctioning means is disposed on the side wall of the suctioning cover for treating the inner part, whereby the auxiliary suctioning member is disposed on the side wall of the suctioning cover for treating the inner part, which side wall is ahead of the blasting nozzle for spraying particles in the direction of the movement of the plate-like member relative to the blasting nozzle for spraying particles.

11. The apparatus for treating a plate-like member of claim 7, wherein a guide member that introduces the outside air is disposed at the open end section of the suctioning cover for treating the inner part of the apparatus for treating a plate-like member.

12. The apparatus for treating a plate-like member of claim 1, wherein the mouth of the blasting nozzle for treating the peripheral part has a rectangular shape.

13. The apparatus for treating a plate-like member of claim 7, wherein the mouth of the blasting nozzle for treating the inner part has a rectangular shape.

14. The apparatus for treating a plate-like member of claim 12, wherein at least one of the blasting nozzle for treating the peripheral part comprises:

a main body of the blasting nozzle for spraying particles;

an air nozzle that introduces compressed air into the inside of the main body of the blasting nozzle and that produces negative pressure in the main body of the blasting nozzle for spraying particles; and a spraying section that comprises a mouth of the nozzle, from which the particles that are suctioned into the inside of the main body of the blasting nozzle by the negative pressure and that are mixed with the compressed air in the mixing chamber within the main body of the blasting nozzle are sprayed.

15. The apparatus for treating a plate-like member of claim 1 or 4, wherein the chamber to treat the peripheral part has one or more adjoining cleaning chambers to treat the peripheral part, which cleaning chamber or chambers suction the sprayed particles attached to the surface of the workpiece and the dust produced by the blasting treatment.

16. The apparatus for treating a plate-like member of claim 15, wherein the cleaning chamber to treat the peripheral part comprises:

a suctioning cover for cleaning the peripheral part, the suctioning cover having a hollow center, having one of its end-sides that forms the ceiling being closed and having the other end-side that is opposed to the ceiling being open;

an air-blowing nozzle for cleaning the peripheral part, the air-blowing nozzle separating and removing the sprayed particles and the dust attached to the surface of the workpiece by blowing the compressed air on the surface, the air-blowing nozzle being disposed on the suctioning cover in such a way that the mouth of the nozzle is covered by the walls of the suctioning cover for cleaning the peripheral part; and a suctioning member for cleaning the peripheral part, the suctioning member having both end sides being kept open and the end-sides communicating with the suctioning cover for cleaning the peripheral part and a suctioning means, respectively, wherein a gap can be provided between the open end section of the suctioning cover and the surface of the workpiece so that the outside air can be suctioned through it.

17. The apparatus for treating a plate-like member of claim 16, wherein a guide member that introduces the outside air is disposed at the open end section of the cleaning chamber to treat the peripheral part.

18. The apparatus for treating a plate-like member of claim 6, wherein the chamber to treat the inner part of the apparatus for treating a plate-like member comprises an adjoining cleaning chamber to treat the inner part, which cleaning chamber suctions and recovers the sprayed particles and the dust that are produced by the blasting treatment and are attached to the surface of the workpiece.

19. The apparatus for treating a plate-like member of claim 18, wherein the cleaning chamber to treat the inner part comprises:

a suctioning cover for cleaning the inner part, the suctioning cover having a hollow center, and having one of its end sides that forms the ceiling being closed and having the other end-side that is opposed to the ceiling being open;

an air-blowing nozzle for cleaning the inner part, the air-blowing nozzle separating and removing the sprayed particles and the dust attached to the surface of the workpiece by blowing the compressed air on the surface of the workpiece, the air-blowing nozzle for cleaning the inner part being disposed on the suctioning cover in such a way that the mouth of the nozzle is covered by the walls of the suctioning cover for cleaning the inner part; and the suctioning member for cleaning the inner part having both end-sides being kept open and the end sides communicating with the suctioning cover for cleaning the inner part and the suctioning means, respectively, wherein a gap can be provided between the open end section of the suctioning cover and the surface of the workpiece so that the outside aft can be suctioned through it.

20. The apparatus for treating a plate-like member of claim 19, wherein the cleaning chamber to treat the inner part comprises at the open end section of the cleaning chamber to treat the inner part a guide member that introduces the outside air.

21. The apparatus for treating a plate-like member of any one of claims 1, 4 and 6, wherein the means to move a plate-like member comprises a transfer mechanism that carries the plate-like member on it and moves the plate-like member in the process of the treatment.

22. The apparatus for treating a plate-like member of claim 21, wherein the apparatus comprises a device to turn the plate-like member, of which the peripheral part has already been treated, by about 90 degrees.

23. The apparatus for treating a plate-like member of claim 22, wherein the apparatus comprises a means to carry in the plate-like member to the area where the peripheral part of the plate-like member is treated, wherein the means to carry in the plate-like member comprises rollers for transport made of urethane foam having a structure that includes separated air bubbles.

24. The apparatus for treating a plate-like member of claim 23, wherein the means to carry in the plate-like member comprises a means to determine the position to stop (hereafter, "positioning means") where the plate-like member that was transferred is to stop.

25. The apparatus for treating a plate-like member of claim 24, wherein the means to determine the position to stop comprises a means to determine a position in the direction of the transport (hereafter, "transporting direction") of the plate-like member, which means determines the position to stop the plate-like member in the transporting direction, the means to determine the position to stop in the transporting direction comprising at least one member for determining the position in the transporting direction of the plate-like member, having a cylindrical shape, the positioning means being disposed perpendicular to the transporting direction of the plate-like member.

26. The apparatus for treating a plate-like member of claim 25, wherein the means to determine the position to stop comprises a means to determine the position in the direction perpendicular to the transporting direction of the plate-like member (hereafter, "perpendicular direction"), which means determines the position to stop on the side to be treated of the workpiece, the means to determine the position in the perpendicular direction comprising at least one member for determining the position to stop in the perpendicular direction, having a cylindrical shape.

27. The apparatus for treating a plate-like member of claim 23, wherein the apparatus for treating a plate-like member comprises a means to carry out the plate-like member, which member carries out the plate-like member out of the area where and when the treatment of the peripheral part the plate-like member was completed, wherein the means to carry out the plate-like member comprises rollers for transport made of urethane foam having a structure that includes separated air bubbles.

28. The apparatus for treating a plate-like member of any one of claims 1, 4, and 6, wherein the apparatus for treating a plate-like member treats the plate-like member that is a solar battery panel that has a thin-film layer, that are required to form a solar battery panel, formed on the surface of the translucent substrate.

29. A method of treating a plate-like member of any one of claims 1, 4, and 6, comprising the steps of:

inserting the peripheral part of the plate-like member, which is a workpiece to be treated, into the opening;

spraying the particles from the blasting nozzle for spraying particles for treating the peripheral parts;

removing the unnecessary thin-film layers on the surface of the workpiece with the sprayed particles; and moving, by the suctioning force of the suctioning means, the sprayed particles and the dust that are produced by the blasting treatment toward the suctioning cover for treating the peripheral part and suctioning them by the suctioning means.

30. The method of treating a plate-like member of claim 22, comprising the steps of;

moving the plate-like member in such a direction that the peripheral part of the plate-like member is inserted into the gap whereby removing the unnecessary thin film layer on the peripheral part of the side first to be treated of the plate-like member;

turning the plate-like member, of which the treatment of the side first to be treated is completed, by about 90 degrees and moving the plate-like member to the position where the treatment starts; and moving the plate-like member in such a direction that the peripheral part of the plate-like member is inserted into the gap, whereby removing the unnecessary thin film Dyer on the side adjacent to the side first to be treated of the plate-like member is carried out.

31. A method of treating a plate-like member of claim 21, comprising the steps of;

inserting the peripheral part of the plate-like member, which is a workpiece to be treated, into the opening;

spraying the particles from the blasting nozzle for spraying particles for treating the peripheral parts;

removing the unnecessary thin film layers on the surface of the workpiece with the sprayed particles; and moving, by the suctioning force of the suctioning means, the sprayed particles and the dust that are produced by the blasting treatment toward the suctioning cover for treating the peripheral part and suctioning them by the suctioning means.

32. The apparatus for treating a plate-like member of claim 13, wherein the blasting nozzle for treating the inner part comprises:

a main body of the blasting nozzle for spraying particles;

an air nozzle that introduces compressed air into the inside of the main body of the blasting nozzle and that produces negative pressure in the main body of the blasting nozzle for spraying particles; and a spraying section that comprises a mouth of the nozzle, from which the particles that are suctioned into the inside of the main body of the blasting nozzle by the negative pressure and that are mixed with the compressed air in the mixing chamber within the main body of the blasting nozzle are sprayed.

* * * * *

UNITED STATES PATENT AND TRADEMARK OFFICE

CERTIFICATE OF CORRECTION

PATENT NO. : 9,308,624 B2
APPLICATION NO. : 13/514413
DATED : April 12, 2016
INVENTOR(S) : Kazumichi Hibino et al.

It is certified that error appears in the above-identified patent and that said Letters Patent is hereby corrected as shown below:

Claim 14, col. 29, line 28, "wherein at least one of the blasting nozzle" should read -- wherein the blasting nozzle --.

Claim 19, col. 30, line 43, "the outside aft" should read -- the outside air --.

Claim 30, col. 32, lines 22-23, "thin film Dyer on the side" should read -- thin film layer on the side --.

Signed and Sealed this
Fifth Day of July, 2016

Michelle K. Lee

Michelle K. Lee
*Director of the United States Patent and Trademark Office*